US011691239B2

(12) United States Patent
Yang et al.

(10) Patent No.: US 11,691,239 B2
(45) Date of Patent: Jul. 4, 2023

(54) CARBIDE BLADE GRINDING FORMING PROCESSING PRODUCTION LINE

(71) Applicants: QINGDAO UNIVERSITY OF TECHNOLOGY, Shandong (CN); NINGBO SANHAN ALLOY MATERIAL CO., LTD., Zhejiang (CN)

(72) Inventors: Min Yang, Qingdao (CN); Changhe Li, Qingdao (CN); Shuo Yin, Qingdao (CN); Liang Luo, Qingdao (CN); Weixi Ji, Qingdao (CN); Binhui Wan, Qingdao (CN); Wenfeng Ding, Qingdao (CN); Haogang Li, Qingdao (CN); Huajun Cao, Qingdao (CN); Bingheng Lu, Qingdao (CN); Lizhi Tang, Qingdao (CN); Xin Cui, Qingdao (CN); Mingzheng Liu, Qingdao (CN); Yanbin Zhang, Qingdao (CN); Jie Xu, Qingdao (CN); Huiming Luo, Qingdao (CN); Haizhou Xu, Qingdao (CN); Huaping Hong, Qingdao (CN); Teng Gao, Qingdao (CN); Yuying Yang, Qingdao (CN); Wuxing Ma, Qingdao (CN); Shuai Chen, Qingdao (CN)

(73) Assignees: QINGDAO UNIVERSITY OF TECHNOLOGY, Qingdao (CN); NINGBO SANHAN ALLOY MATERIAL CO., LTD., Zhejiang (CN)

( * ) Notice: Subject to any disclaimer, the term of this patent is extended or adjusted under 35 U.S.C. 154(b) by 169 days.

(21) Appl. No.: 17/341,046

(22) Filed: Jun. 7, 2021

(65) Prior Publication Data

US 2022/0055171 A1 Feb. 24, 2022

(30) Foreign Application Priority Data

Aug. 19, 2020 (CN) ..... 202010837417.9

(51) Int. Cl.

| | |
|---|---|
| ***B24B 3/36*** | (2006.01) |
| ***B24B 41/00*** | (2006.01) |
| ***B24B 49/12*** | (2006.01) |

(52) U.S. Cl.

CPC ..... *B24B 3/36* (2013.01); *B24B 41/005* (2013.01); *B24B 49/12* (2013.01)

(58) Field of Classification Search

CPC . B24B 3/36–546; B24B 41/005; B24B 49/12; B24B 7/16; B24B 9/02;

(Continued)

(56) References Cited

U.S. PATENT DOCUMENTS 8,915,766 B1 * 12/2014 Kolchin ..... B24B 49/12 451/5
2017/0087690 A1 * 3/2017 Vogel ..... B24B 3/54

(Continued)

FOREIGN PATENT DOCUMENTS

CN 108481158 A * 9/2018 ..... B08B 3/12
CN 106424944 B * 11/2018 ..... B23D 65/00
KR 20170083412 A * 7/2017

*Primary Examiner* — Joel D Crandall
*Assistant Examiner* — Michael A Gump
(74) *Attorney, Agent, or Firm* — Oliff PLC

(57) ABSTRACT

The present disclosure provides a carbide blade grinding forming processing production line, relates to the field of blade processing in forming, and provides a production line for grinding forming processing of a carbide blade with inscribed circular holes, which has functions of blade grinding forming processing, blade cleaning and drying and detection of external dimension of a formed blade, and has an automatic loading and uninstalling function. In most processing course of the blade, the cutter head is taken as a (Continued)

carrier, and an overturning device is configured to overturn a whole cutter die box, such that integral end surface overturning of the cutter head in the cutter die box after single end surface grinding is realized, and blade filling processes in different processing links are reduced.

9 Claims, 15 Drawing Sheets

(58) Field of Classification Search
CPC ..... B24B 27/0076; B24B 55/06; B24B 51/00; B24B 41/02; B24D 18/009
USPC ..... 451/5
See application file for complete search history.

(56) References Cited

U.S. PATENT DOCUMENTS

| | | | | |
|---|---|---|---|---|
| 2017/0355031 | A1* | 12/2017 | Metelsky | B23F 23/12 |
| 2019/0210177 | A1* | 7/2019 | Graves | B24B 55/02 |
| 2019/0358763 | A1* | 11/2019 | Hessler | B24B 3/54 |
| 2020/0246933 | A1* | 8/2020 | Fowler | B24B 49/12 |

* cited by examiner

Partial view ii

Partial view iii
4:1

CARBIDE BLADE GRINDING FORMING PROCESSING PRODUCTION LINE

BACKGROUND

Technical Field

The present disclosure relates to the field of blade processing in forming, in particular to a carbide blade grinding forming processing production line.

Related Art

The description in this section merely provides background information related to the present disclosure, and does not necessarily constitute the prior art.

At present, the manufacturing process of a carbide blade mainly includes technological processes of powder production, powder pressing, high-temperature sintering, blade grinding, blade passivation and coating. The grinding processing procedure of the carbide blade mainly adopts a method of grinding processing with a diamond grinding wheel. Through blade end surface grinding, polishing, peripheral grinding, blade slotting, cutting edge grinding and the like, followed by passivation and coating, the final production process of the carbide blade is completed.

The inventor finds that various automatic grinding machines in the current carbide blade production workshop are relatively independent. A cutter head of a blade grinding machines is fed or discharged by a special person, and manually conveyed to a next production link by an operator after one grinding procedure link is completed. Therefore, the production efficiency is low. Different grinding machines have different loading and uninstalling modes. Thus, the operator carries out blade grinding processing according to the loading and uninstalling modes applicable to the blade grinding machines in the corresponding working procedure. During the processing, the cutter head is usually used as a carrier for blade loading and uninstalling, the blade is filled in the cutter head manually, and thus workers carry out a large amount of repetitive work in the working process, which increases the labor load of the workers and causes low efficiency. Meanwhile, sharp corners and side edges of the blade easily scratch the filling workers, posing certain safety risks. As for the grinding of the end surface of the blade, there are high requirements on the end surface precision of the blade. With the limitation of grinding processing apparatuses, generally, one end surface of the blade is ground by a single-end-surface grinding machine, the blade is then inverted so that the other end surface of the blade can be ground. However, because the blades are filled in a cutter die box, the blades are difficult to integrally overturn, and the blades are overturned successively manually after single end surfaces of the blades are processed, so that the efficiency is low, and the requirement of the processing efficiency is difficult to meet.

SUMMARY

Aiming at the defects in the prior art, the present disclosure provides a carbide blade grinding forming processing production line, and provides a production line for grinding forming processing of a carbide blade with inscribed circular holes, which has functions of blade grinding forming processing, blade cleaning and drying and detection of external dimension of formed blades, and has an automatic loading and uninstalling function. In the most processing courses of the blades, cutter head is taken as a carrier, and an overturning device is configured to overturn the whole cutter die box, so that the whole end surface of the cutter head after single end surface grinding in the cutter die box is overturned, and the filling processes of the blades in different processing links are reduced.

To achieve the foregoing objective, this application adopts the following technical solutions.

A carbide blade grinding forming processing production line includes:

a supply unit, including a cutter die box overturning device matched with a processing unit and a loader matched with a conveying unit, an overturning cavity for accommodating the cutter die box is formed in an overturning unit of the cutter die box overturning device;

the processing unit, configured to grind and clean a blade, and including an end surface grinding machine, a periphery grinding machine and a cleaning device, the end surface grinding machine being provided with an end surface grinding station for accommodating the cutter die box, the periphery grinding machine being provided with a periphery grinding station, and the cleaning mechanism being matched with the end surface grinding machine and the periphery grinding machine;

the conveying unit, including a transportation mechanism, a filling manipulator, and a storage device, both the transportation mechanism and the filling manipulator being matched with the supply unit, the processing unit and a detection unit, and the storage device being matched with the filling manipulator; and the detection unit, including an image acquisition device and configured to acquire image information of the blade on a fixing table and transmitting the image information to the controller.

Further, the overturning device includes an overturning unit, a fixing plate rotatably connected to the overturning unit and an uninstall rod matched with an overturning cavity, an access channel which penetrates through the fixing plate and corresponds to the overturning cavity is formed in the fixing plate, the uninstall rod moves relatively to the overturning cavity for pushing the cutter die box out of the overturning cavity along the access channel.

Further, the overturning cavity penetrates through the overturning unit, the overturning unit is provided clapboard sliding grooves corresponding to openings in two ends of the overturning cavity, and an overturning clapboard is matched in the clapboard sliding groove for blocking or opening the overturning cavity.

Further, a cutter head rotating machine includes a vibratory feeding mechanism, a guiding mechanism, a loading mechanism, and a discharging mechanism which are successively arranged, the guiding mechanism receives the blade discharged from the vibratory feeding mechanism and conveys the blade to the loading mechanism, and the loading mechanism conveys the cutter head filled with the blade to the discharging mechanism for discharging.

Further, the cleaning device includes a water jet cleaning mechanism, an ultrasonic cleaning mechanism, and an air drying mechanism which are successively arranged for water jet cleaning, ultrasonic cleaning and air drying of the blade filled in the cutter head.

Further, the transportation mechanism includes a blade slope transportation belt, a discharged cutter head conveying belt, a cutter head loading and uninstalling moving machine and an intelligent cutter head conveying belt; and the filling manipulator includes a cutter head loading and uninstalling manipulator and an inventory filling manipulator.

Further, the storage device includes cutter head brackets arranged in an array, an induction chip is arranged on a bottom plate of the cutter head bracket in a matched manner, a fixing groove matched with the cutter head is formed in a side surface of the cutter head bracket, and a slot for accommodating the tail end of the filling manipulator is formed in a side surface of a cutter head tray.

Further, the cutter head bracket is mounted on a support, and the cutter head loading and uninstalling manipulator is mounted on the support, and cooperates with the cutter head brackets to take out or store the cutter head.

Further, the collecting unit further includes a loading and uninstalling robot and a collecting driver which are mounted on a fixing table, the collecting driver includes a rotating rack, a placement rod and a fixed rack, the placement rod and the fixed rack are arranged on the rotating rack at an interval, one end of the placement rod is fixed to the rotating rack, and a placement table used for placement of the blade is formed at the other end of the placement rod.

Further, the image acquisition device includes a first camera mounted above the placement table and a second camera mounted beside the placement table, a first reflector is arranged on the side, which is away from the first camera, of the placement table, a second reflector is arranged on the side, which is away from the second camera, of the placement table, and the placement table is used for driving the blade to rotate relative to the image acquisition device.

Compared with the prior art, the present disclosure has the following advantages and the positive effects:

(1) The grinding forming processing production line for the carbide blade with inscribed circular holes is provided, which has functions of blade grinding forming processing, blade cleaning and drying and detection of external dimension of formed blades, and has an automatic loading and uninstalling function. In the most processing courses of the blades, the cutter head is taken as a carrier, and the overturning device is configured to overturn the whole cutter die box, so that integral end surface overturning of the cutter head after single end surface grinding in the cutter die box is realized, and the filling processes of the blades are reduced in different processing links.

(2) The automation degree is high in the blade grinding forming processing course of the production line, the blade of which the end surface is ground are loaded on the cutter head through the loader, and the cutter head is taken as a blade feeding carrier for a subsequent processing link, which unifies the blade feeding form, and simplifies the blade conveying process.

(3) A single-end-surface grinding machine is adopted in the production line for blade end surface grinding, so that the blade end surface grinding precision is favorably controlled, and the apparatus cost is controlled. In the end surface grinding and feeding process, the problem of disassembly and refilling during blade end surface grinding can be solved through the cutter die box overturning device, the labor intensity of workers is reduced, and the productivity is improved.

(4) Automatic batch filling of the blade to the cutter head can be realized by a blade gravity discharging loader of the production line, labor input for filling the blade into the cutter head in the production line is reduced, and meanwhile, the cutter head filled with the blade meet feeding requirements of a blade periphery grinding machine. A cutter head conveying belt of the production line is triggered to work by sensing of a sensor, the cutter head is placed on the conveying belt by a manipulator at the upper end, a control system is triggered to start the conveying belt after monitoring of the sensor, the cutter head is conveyed to a specified position and then a cutter head taking signal is sent to a manipulator at the tail end, and the cutter head is taken away. A cutter head transfer station storage device is arranged between two kinds of apparatuses in different processing procedures and has capability of storing a certain number of cutter heads. When a certain apparatus of the production line fails and stops, the blade produced in the link at the upper end may be temporarily stored through a transfer station at a starting end, and the blade in the production process at the lower end is taken from a transfer station at the tail end, so that the influence of failure of the apparatus on the continuous processing of the production line is reduced to the greatest extent.

(5) The production line is provided with a device in the cutter head for cleaning and air-drying the blade, so that a blade cleaning function which is not fulfilled by most blade grinding machines is achieved, the surface of the blade is clean after cleaning and air drying, and the subsequent visual monitoring accuracy of the blade is directly improved.

(6) A blade visual monitoring device of the production line can monitor a plurality of geometric parameters of the blade and the edge of the peripheral cutting edge of the blade. Meanwhile, an image acquisition camera may automatically adjust the camera image acquisition angle according to different types of blades, such that the monitoring effect is guaranteed, and accurate monitoring in the blade production process is realized.

BRIEF DESCRIPTION OF THE DRAWINGS

The accompanying drawings constituting a part of the present disclosure are used to provide further understanding of the present disclosure. Exemplary embodiments of the present disclosure and descriptions thereof are used to explain the present disclosure, and do not constitute an improper limitation to the present disclosure.

FIG. 3(*b*) is an axonometric view of a cutter die box according to Embodiment 1; FIG. 3(*c*) is an axonometric view of the cutter die box filled with the blade according to Embodiment 1;

FIG. 3(*d*) is a top view of the cutter die box filled with the blade according to Embodiment 1;

FIG. 8(*b*) is a partial enlarged view of a part i in FIG. 8 (*a*);

FIG. 19(*b*) is an axonometric view of a tray temporary storage device at the tail end of the conveying belt for cutter head unit conversion according to Embodiment 1;

FIG. 19(*c*) is a top view of the tray temporary storage device at the tail end of the conveying belt for cutter head unit conversion according to Embodiment 1;

FIG. 28(*b*) is a front view of the feeding positioning plate of the blade drying device according to Embodiment 1;

FIG. 28(*c*) is a partial enlarged view of a part ii in FIG. 28(*a*);

FIG. 28(*d*) is a top view of the feeding positioning plate of the blade drying device according to Embodiment 1;

FIG. 31(*b*) is a cross-sectional view at A-A of FIG. 31(*a*);

FIG. 31(*c*) is a partial enlarged view at iii of FIG. 31(*b*);

FIG. 32(*b*) is a top view of the image acquisition device of the blade visual detection apparatus according to Embodiment 1;

Figure 1:
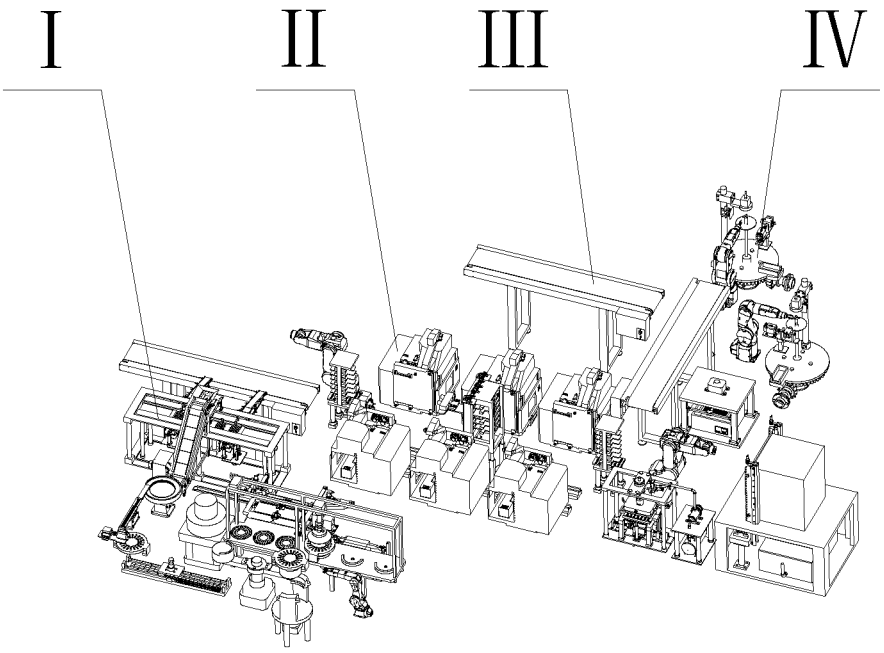
FIG. 1 is an axonometric view of an intelligent production line system for grinding processing of a carbide blade according to Embodiment 1.

In the drawings, I—blade supply unit, II—blade processing unit, III—blade conveying unit, and IV—blade detection unit.

I-01—carbide blade end surface grinding cutter die box overturning device, I-02—carbide blade gravity discharging loader, II-01—blade end surface grinding machine tool, II-02—blade periphery grinding machine, II-03—blade air dryer, II-04—high-pressure water jet blade cleaning device, II-05—ultrasonic blade cleaning machine, III-01—blade slope conveying belt, III-02—discharged cutter head conveying belt, III-03—blade inventory filling manipulator, III-04—cutter head loading and uninstalling moving machine, III-05—cutter head transfer station storage device, III-06—cutter head loading and uninstalling manipulator, III-07—intelligent cutter head conveying belt, IV-01—visual monitoring work fixing table, IV-02—blade loading and uninstalling robot, IV-03—blade image acquisition device, IV-04—multi-angle image acquisition driver, and IV-05—industrial computer;

I-0101—cutter die box overturning clapboard, I-0102—overturning clapboard driver, I-0103—cutter die box overturning unit, I-0104—overturning unit driver, I-0105—coupling, I-0106—motor damping buffer, I-0107—motor fixing plate, I-0108—motor fixing shell, I-0109—lifting driving motor, I-0110—motor lifting guiding rod, I-0111—lead screw nut block, I-0112—lifting lead screw, I-0113—lifting device fixing bottom plate, I-0114—blade overturning device component fixing plate, I-0115—cutter die box uninstall rod; I-0201—blade spiral vibratory feeding device, I-0202—blade forming storage device, I-0203—blade loading device, I-0204—cutter head discharging device, II-0201—blade end surface grinding cutter die box, II-0202—carbide blade, II-0301—air drying gas preparation machine, II-0302—cutter head air drying fixing platform, II-0303—blade air dryer, II-0304—air dryer driver, II-030201—cutter head air drying fixing plate; II-0401—blade high-pressure cleaning water supply device, II-0402—water jet blade cleaning device, and II-0403—blade cleaning chamber; II-0501—ultrasonic blade cleaning box, II-0502—ultrasonic cleaning control plate, II-0503—lifting cleaning driver, and II-0504—cutter head cleaning box; III-0201—conveying belt fixing support, III-0202—cutter head conveying clapboard, III-0203—cutter head conveying belt, III-0204—discharged cutter head detection sensor, III-0205—cutter head temporary storage device at the tail end; III-0401—transporter lifting driver, III-0402—cutter head vertical placement frame, III-0403—cutter head telescopic grabbing manipulator, III-0404—height-adjustable support, III-0701—cutter head state monitoring sensor, III-0702—cutter head chain type conveying belt, III-0703—cutter head conveying belt support, III-0704—cutter head gliding roller, III-0705—cutter head pose adjusting elastic strip, III-0706—cutter head temporary storing tray, III-0707—cutter head sensing pressure sensor, and III-0708—cutter head cushioning plate; IV-0301—vertical back light fixing frame, IV-0302—image acquisition light source, IV-0303—vertical back light, IV-0304—position-adjustable fixing sliding block, IV-0305—vertical camera fixing clamp, IV-0306—CCD camera 1, IV-0307—horizontal backlight, IV-0308—horizontal camera fixing clamp, IV-0309—motor fixing frame, IV-0310—camera rotation driving motor, IV-0311—electric telescopic rod, IV-0312—annular illumination light source, IV-0313—CCD camera 2, IV-0401—disc rotation driving motor, IV-0402—motor fixing seat, IV-0403—coupling, IV-0404—bearing block 1, IV-0405—bearing 1, IV-0406—gear driving shaft, IV-0407—driving bevel gear, IV-0408—gear fixing nut, IV-0409—rotating plate, IV-0410—thrust bearing, IV-0411—rotation driving plate, IV-0412—bearing 2, IV-0413—bearing block 2, IV-0414—supporting bevel gear, IV-0415—bearing 3, IV-0416—bearing block 3, IV-0417—blade placement rod, IV-0418—bearing 4, and IV-0419—bearing block 4;

I-010101—clapboard moving sliding track, I-010102—clapboard connecting fixing hole, I-010201—clapboard lifting connecting rod, I-010202—clapboard moving balance spring, I-010301—cutter die box overturning unit rotating shaft, I-010302—clapboard moving sliding groove, I-010303—clapboard driver mounting boss, I-010304—cutter die box access hole, I-011401—lifting lead screw hinged side plate fixing hole, I-011402—clapboard driver overturning hole, I-011403—cutter die box access opening, I-011404—overturning unit rotating shaft positioning hole, I-011405—overturning driver fixing plate, I-011501—cutter die box uninstall rod sliding base, I-011502—cutter die box push plate, I-011503—manual uninstallation grabbing rod, and I-020301—blade conveying plate; and II-040101—cleaning water supply tank, II-040102—recirculation water filter, II-040103—recirculation water collecting tank, II-040201—nozzle driving motor, II-040202—near end bearing block, II-040203—water jet nozzle, II-040204—electromagnetic water flow control switch, II-040205—nozzle cushion block, II-040206—nozzle moving fixing plate, II-040207—guide track, II-040208—sliding block, II-040209—far end bearing block, II-040210—water supply pipe, II-040211—cleaning component fixing plate, II-040212—lead screw end bearing, II-040213—lead screw sliding block, II-040214—linear moving driving lead screw, and II-040215—coupling joint.

DETAILED DESCRIPTION

It should be noted that the following detailed descriptions are all exemplary and are intended to provide a further description of the present disclosure. Unless otherwise specified, all technical and scientific terms used herein have the same meaning as commonly understood by a person of ordinary skill in the technical field to which the present disclosure belongs.

It should be noted that terms used herein are only for describing specific implementations and are not intended to limit exemplary implementations according to the present disclosure. As used herein, the singular form is intended to include the plural form, unless the context clearly indicates otherwise. In addition, it should further be understood that terms "comprise" and/or "include" used in this specification indicate that there are features, steps, operations, devices, components, and/or combinations thereof.

For ease of description, words "up", "down", "left", and "right" appearing in the present disclosure only mean that they are consistent with the up, down, left, and right directions of the drawings themselves, and do not limit the structure. It is for the convenience of describing the present disclosure and simplifying the description, rather than indicating or implying that the device or element referred to must have a specific orientation, be constructed and operated in a specific orientation, and therefore cannot be understood as a limitation of the present disclosure.

As introduced in the Related art, various automatic grinding machines in a carbide blade production workshop in the prior art are relatively independent, the loading and uninstalling of cutter head of blade grinding machines is carried out by a special person, and the cutter head is manually conveyed to a next production link by an operator after one grinding procedure link is completed, which causes low production efficiency. Aiming at the problem, the present disclosure provides a carbide blade grinding forming processing production line.

Embodiment 1

In a typical embodiment of the present disclosure, as shown in FIG. 1 to FIG. 35, provided is a carbide blade grinding forming processing production line.

FIG. 1 is an axonometric view of an intelligent production line system for grinding processing of a carbide blade. The production line totally includes a blade supply unit I, a blade processing unit II, a blade conveying unit III and a blade detection unit IV. For these units, the real-time monitoring of states is realized through an apparatus body system and sensors of different types, communication connection of apparatus is established by a communication technology, and all kinds of information are fed back to a functional sub-system and a main control system in a production process, such that the processing course is carried out according to a pre-set program in the processing course and real-time intelligent processing of the fed back information by an intelligent module in the process, thereby realizing the intelligent running of the intelligent production line system for grinding processing of the carbide blade.

Meanwhile, an alarm can be given when the system detects abnormalities. When the function of a certain unit of the system is abnormal integrally, the system suspends the unit and temporarily isolates this working unit from the control system, and other units continue to process according to actual conditions, ensuring the continuity of the processing course to the greatest extent. When the fault is removed and a maintenance person manually initializes a certain functional module, the main control system collects and records current working state information data and initializes a main system of the production line. A fault unit module is connected into the system, and processing is continued according to the working state data recorded before initialization. At this moment, information such as materials and processing progress is shared and updated again among the units, and the main control system calculates the working rhythm of each unit apparatus with an intelligent algorithm, and controls the processing rhythm for a period of time thereafter by taking the working rhythm as a reference, such that the working rhythm of the production line with the highest efficiency is recovered in the shortest time.

At least two apparatuses of the main working components of each working unit in the system are used for parallel work, so that overall failure shutdown of a certain working unit of the production line is less likely to occur. Whenever the system has a fault state on a certain apparatus or a fault on a certain working unit, other functions of the production line during apparatus maintenance can normally run, and the apparatus or the working unit can work rapidly after maintenance is completed. According to the working mode under the fault state of the system, the continuous working capacity of the production line system is high, the working robustness of the system is also high, and the stability is good.

Figure 2:
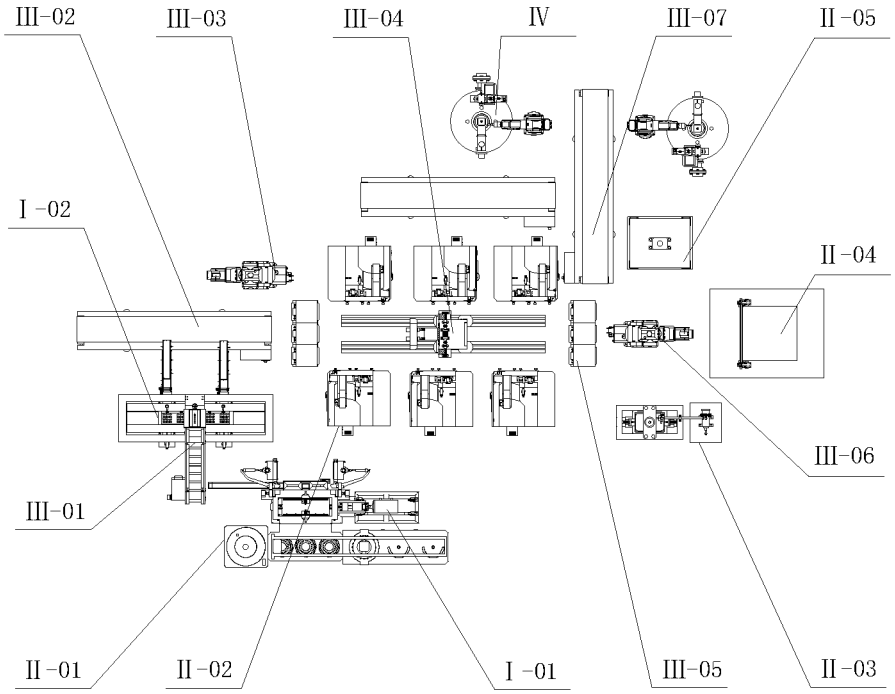
FIG. 2 is a top view of the intelligent production line system for grinding processing of the carbide blade according to Embodiment 1.
Figure 3A:
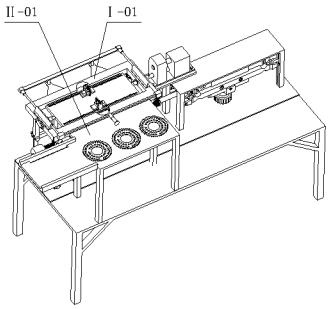
FIG. 3(*a*) is an axonometric view of a feeding table of a grinding plate for end surfaces of the carbide blade according to Embodiment 1.
Figure 3B:
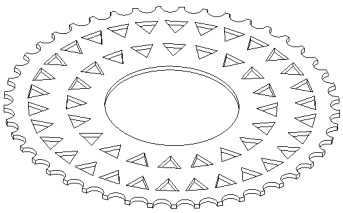
Figure 3C:
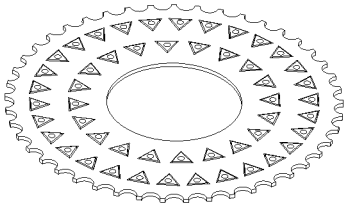
Figure 3D:
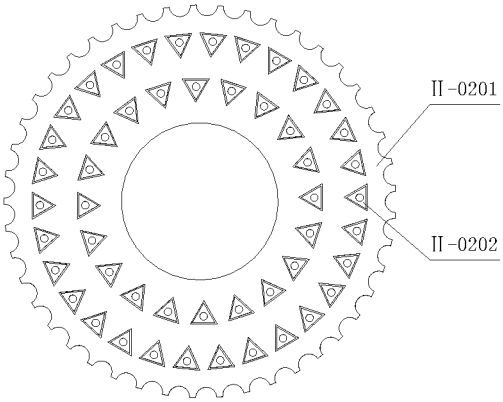
Figure 4:
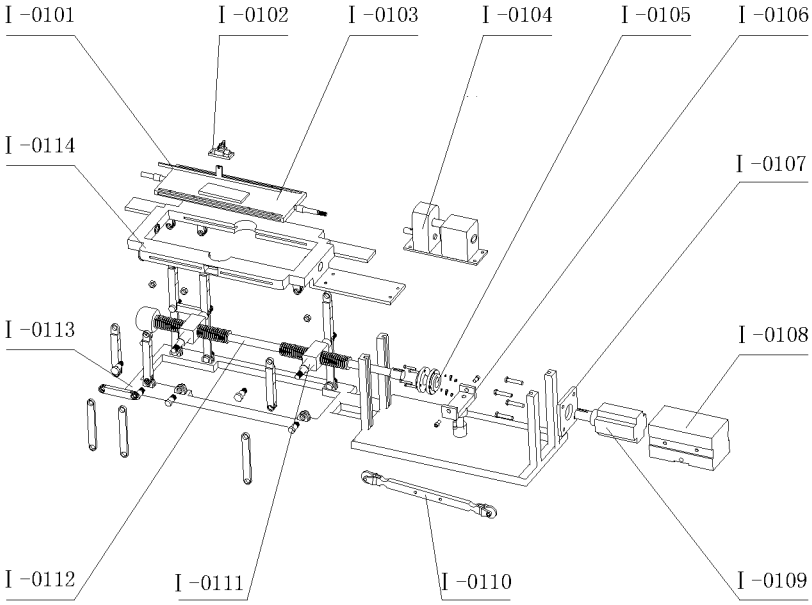
FIG. 4 is an exploded view of assembling components of a blade surface-changing device according to Embodiment 1.
Figure 5:
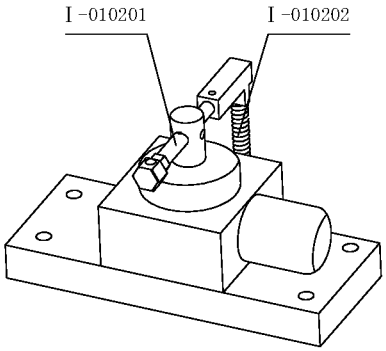
FIG. 5 is an axonometric view of a cutter die box overturning clapboard driver according to Embodiment 1.
Figure 6:
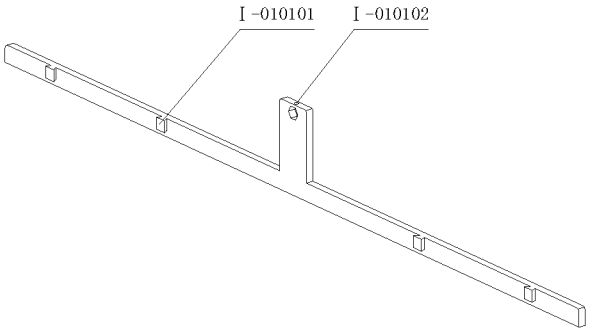
FIG. 6 is an axonometric view of a cutter die box overturning clapboard according to Embodiment 1.
Figure 7:
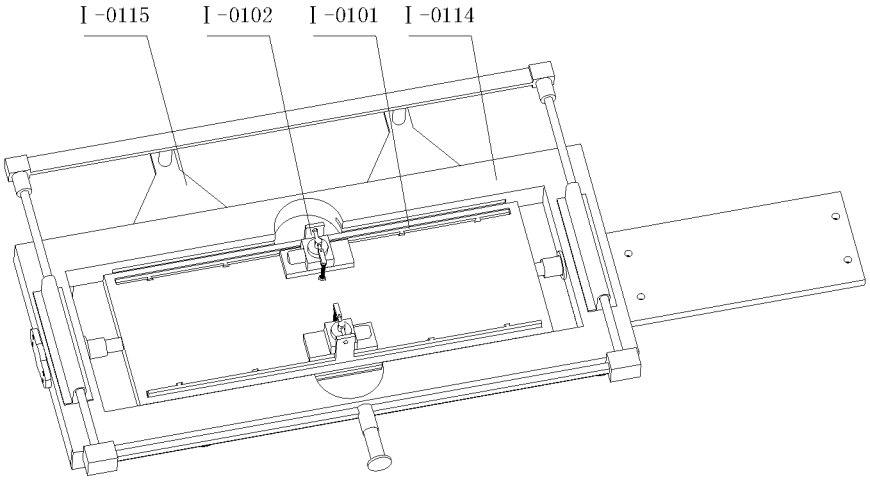
FIG. 7 is an axonometric view of a blade end surface grinding surface-changing device according to Embodiment 1.

FIG. 2 is a top view of apparatus spatial arrangement of an intelligent production line system for grinding processing of the carbide blade. Blades to be ground enter from a carbide blade end surface grinding semi-automatic feeding device I-01, are regularly arranged in a cutter head through the process of grinding processing of the intelligent production line, and are then discharged from a conveying belt at the tail end and fed to a subsequent passivation and coating production line for subsequent processing.

The blade supply unit I mainly has the following two functions in the intelligent production line for grinding processing of the carbide blade: a blade turning function for blade end surface grinding and a function of filling cutter head of an intelligent grinding machine.

After subjected to technological processes of stamping and high-temperature sintering, the carbide blade has the grinding properties such as high hardness and high wear resistance. The carbide blade needs grinding forming with a hard grinding wheel of the grinding machine to obtain the geometric size meeting the requirements and improved grinding performance. The end surface grinding of the blade is the first process link in forming processing, is also referred to as "plane grinding" which has quite high requirements on the end surface precision and blade thickness tolerance of the processed blade, and directly determines the clamping positioning precision of the blade in the subsequent processing. At present, a carbide blade numerical control single-end-surface grinding machine and a numerical control double-end-surface grinding machine may be used for end surface grinding of the blade.

Due to high hardness of hard alloy, the end surface of the blade is difficult to grind. A common double-end-surface grinding machine is difficult to meet the precision requirement, the processing rhythm is slow, and the efficiency is low. An imported numerical control double-end-surface grinding machine can meet the requirement of grinding precision, but it is expensive, which makes the production cost of the carbide blade increased, and thus the market competitiveness of the products is weakened to a great extent.

Therefore, most blade manufacturers use a numerical control single-end-surface grinding machine to grind the end surface of the blade, and realizes double-end-surface grinding of the carbide blade by adopting a secondary blade clamping and feeding mode. This method can effectively improve the grinding precision of the end surface of the carbide blade, the apparatus cost of the numerical control single-end-surface grinding machine is low, and thus, the method is widely applied to enterprises.

Specifically, the implementation of the end surface grinding of the blade is that the blade is filled into a cutter die box, and then the cutter die box is fed to a grinding wheel working area of the grinding machine for grinding. The grinding wheel of the numerical control single-end-surface grinding machine is positioned above the cutter die box, and the grinding of the end surface of the side, which is close to the grinding wheel, of the blade in the cutter die box is completed through single grinding. After the cutter die box is uninstalled, the blade needs to be manually taken out. The surface, which is not ground, is upwards refilled into the cutter die box, and made close to the grinding wheel for grinding. After double end surface of the blade is ground, the blade is conveyed to a next link for subsequent work such as grinding of the peripheral side edge of the blade and processing of a chip breaker groove.

In the embodiment, the processing course is improved through the carbide blade end surface grinding cutter die box overturning device I-01. After single-surface grinding of the blade is completed, the cutter die box is uninstalled to a workbench. The cutter die box overturning device is connected to the side edge of the workbench at the same height, as shown in FIG. 3, II-01 is a blade end surface grinding machine workbench, and I-01 is a blade end surface grinding cutter die box overturning device. The cutter die box is directly pushed into the overturning device for 180-degree rotation, and is then pushed out to the workbench again. A machine tool operator directly feeds the overturned cutter die box into the end surface grinding machine tool for grinding of the other end surface of the blade.

A blade fixing through hole is formed in the cutter die box, the shape of the fixing hole is the same as that of the blade, and the blade is arranged in the cutter die box. For two end surfaces of each blade, the bottom end is used as a supporting surface end, and the upper end surface is a grinding end surface. The supporting end surface serves as a support through the plane, which is in contact with the supporting end surface, of the workbench. After the end surface on one side is ground, the positions of the upper end surface and the lower end surface are interchanged through an overturning mechanism, and the side with the ground end surface serve as a supporting end surface. After the grinding of the other end surface is completed, the grinding of all the end surfaces of the blade is completed. The cutter die box is always in a translation state in the moving process for overturning of the cutter die box and loading and uninstalling of the end surface grinding machine, and the blade is driven to move through the constraint effect of the side wall of the blade fixing through hole of the cutter die box. The cutter die box is integrally positioned between a top surface to be ground of the blade and a bottom surface to be ground of the blade, and the cutter die box has the effect of circumferentially restraining and clamping the blade during grinding.

Figure 8A:
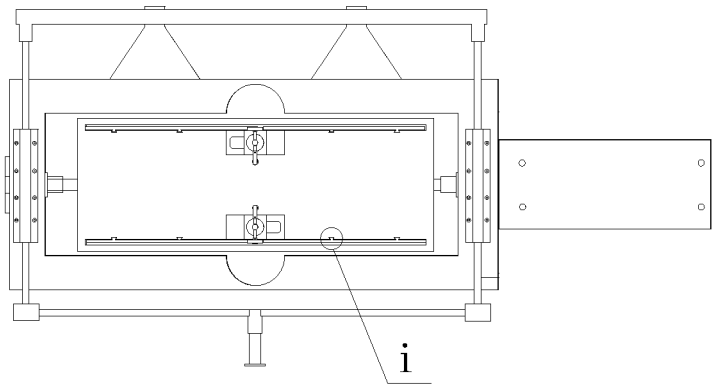
FIG. 8(*a*) is a top view of the blade end surface grinding surface-changing device according to Embodiment 1.
Figure 8B:
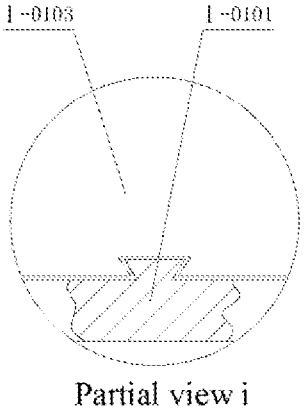
Figure 9:
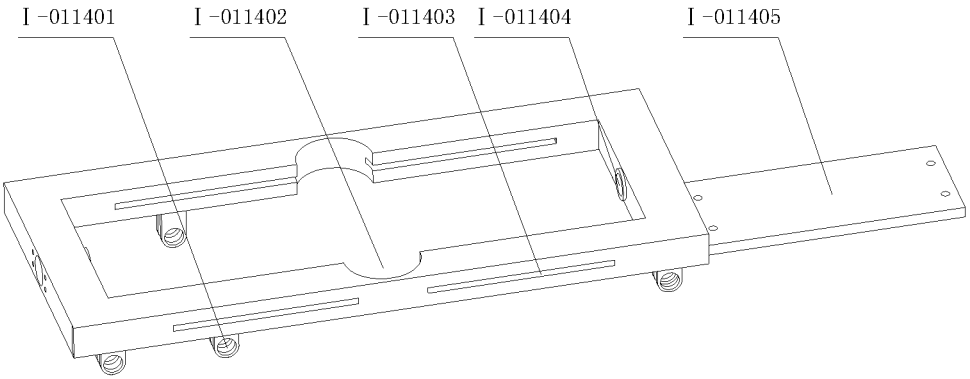
FIG. 9 is an axonometric view of a blade overturning device component fixing plate according to Embodiment 1.
Figure 11:
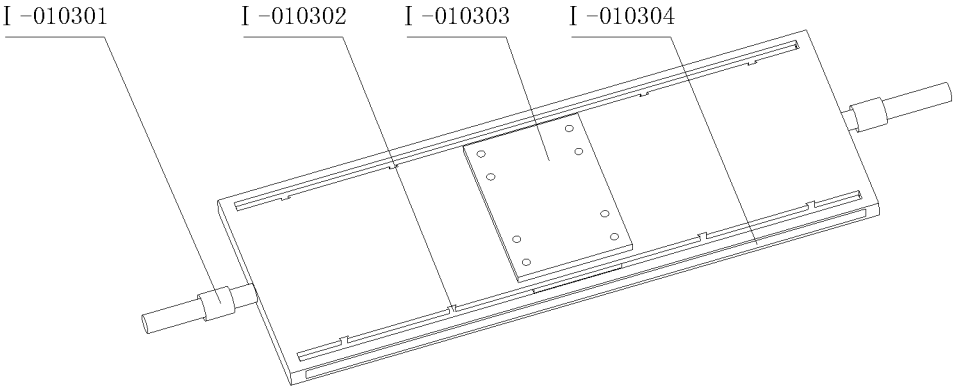
FIG. 11 is a cutter die box turning device according to Embodiment 1.

The main working component of the carbide blade end surface grinding cutter die box overturning device I-01 is a cutter die box overturning unit I-0103, as shown in FIG. 11, the inside of the overturning unit is a rectangular hole groove which has a thickness slightly larger than that of the cutter die box, so as to avoid jamming in entering and exiting process of the cutter die box. A sliding groove is formed in the side portion, and the external dimension of the sliding groove is the same as that of a cutter die box overturning clapboard I-0101. The size of a trapezoidal clapboard moving sliding track I-010101 is matched with that of the clapboard moving slide groove I-010302, and as shown in FIG. 8(*b*), a guiding effect is achieved in the lifting process of the clapboard. The cutter die box overturning clapboard I-0101 is fixed to a clapboard lifting connecting rod I-010201 in an overturning clapboard driver shown in FIG. 5 through a clapboard connecting fixing hole I-010102 at the top end, and a clapboard moving balance spring I-010202 is fixed to the other end of the connecting rod, so that the stress on two sides of the clapboard in the lifting process is uniform, and the working stability is improved.

The lifting process of the overturning clapboard driver is controlled by an electric telescopic device, and the overturning clapboard driver is fixed to a clapboard driver mounting boss I-010303 of a cutter die box overturning unit I-0103 through screws. Two ends of the cutter die box overturning unit I-0103 are connected to cutter die box overturning unit rotating shafts I-010301, and the cutter die box overturning unit is mounted on a blade overturning device component fixing plate I-0114 in cooperation with components such as a bearing, a bearing sleeve and a flange cover. The cutter die box overturning unit rotating shaft I-010301 is mounted in an overturning unit rotating shaft positioning hole I-011404, and the interiors of the two components are connected through a bearing. One end of the blade overturning device component fixing plate is packaged through a flange cover while the rotating shaft of the other end extends out, and is fixedly connected to an overturning unit driver I-0104 through a coupling. When the driver rotates, a cutter die box overturning unit is driven to rotate around the shaft.

The overturning unit driver I-0104 works under the cooperation of a servo motor and a speed reducer and is fixed to an overturning driver fixing plate I-011405 through bolts. The control precision of the alternating-current servo motor used is guaranteed by a rotary encoder at the rear end of a motor shaft, and thus, 180-degree overturning at each time can be guaranteed. Therefore, a cutter die box access hole I-010304 of the overturning unit is superposed to a cutter die box inlet I-011403 of the overturning device component fixing plate after overturning, and the cutter die box uninstall rod I-0115 is manually pulled inwards to eject out the cutter die box to the workbench.

Clapboard driver overturning holes I-011402 are formed in two sides of the middle of the overturning device component fixing plate, and are in arc-shaped design. In an overturning process, it ensures that the clapboard driver can pass therethrough without interference. An electric telescopic rod for the clapboard driver is powered by a miniature battery, and is mounted nearby the periphery of the driver.

Figure 10:
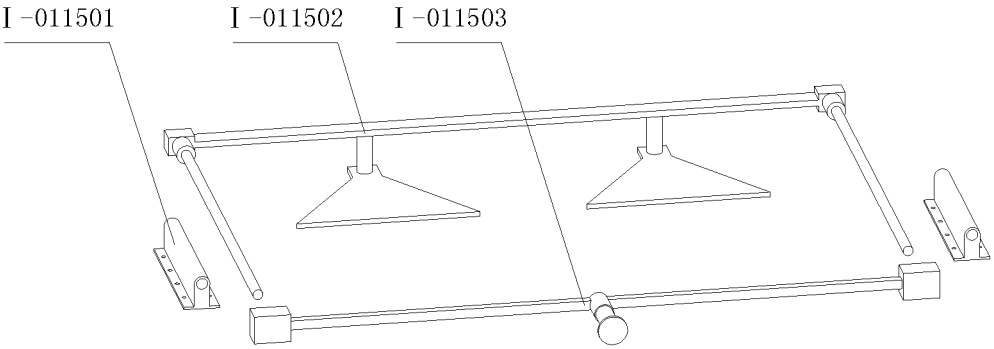
FIG. 10 is an exploded view of assembling components of a cutter die box uninstall rod according to Embodiment 1.

The cutter die box uninstall rod I-0115 is driven manually, as shown in FIG. 10, two ends of a cutter die box push plate I-011502 are fixedly connected to plain shafts which penetrate through shaft holes of a cutter die box uninstall rod sliding base I-011501. The plain shafts and inner walls of shaft holes are regularly coated with lubricating media to ensure the smoothness in a reciprocating push-pull process. The other ends of the plain shafts are connected to fixing blocks at two ends of a manual uninstallation grabbing rod I-011503 through bolts, and a push-pull handle is mounted in the middle of the manual uninstallation grabbing rod.

The lower end of the blade overturning device component fixing plate I-0114 is matched with a motor through a ball screw structure, so that the device has a highly automatic adjustment function for workbenches at different heights.

The hardware of the device is connected to a control chip, and a control button is arranged outside the control chip for button control on the overturning work of the overturning unit. After an operating worker completes filling of the cutter die box and presses down the button, the cutter die box overturning clapboard I-0101 descends to close a cutter die box access opening, and then the driver drives the overturning unit for 180-degree overturning. After the overturning is completed, the cutter die box overturning clapboard I-0101 ascends, the worker pushes out the cutter die box through the manually driven cutter die box uninstall rod I-0115, and thus a working process is completed.

In the production line, by the blade end surface grinding cutter die box overturning device, the grinding of double end surfaces can be completed by one-time filling of the blade into the cutter die box, and a rotator drives the cutter die box to achieve 180-degree overturning, such that the manual turning of the blade is not required, half of blade filling time is saved, the blade end surface grinding efficiency is greatly improved, and the labor intensity of the operator is reduced.

A blade conveying hole is formed in a side of a blade end surface grinding workbench, and a blade conveying belt is mounted at the lower end of the conveying hole. The blade of which the double end surfaces are ground is conveyed into a blade slope conveying belt III-01 through a conveying belt. Under the action of the slope conveying belt, the blade is conveyed into a carbide blade gravity discharging loader I-02 for automatic blade loading.

Figure 12:
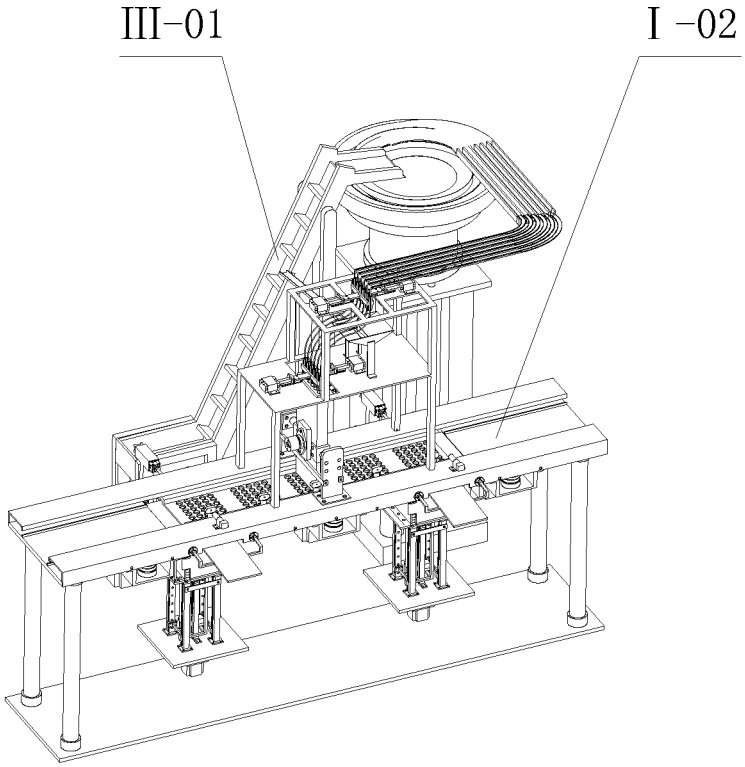
FIG. 12 is an axonometric view of a blade loader apparatus according to Embodiment 1.
Figure 13:
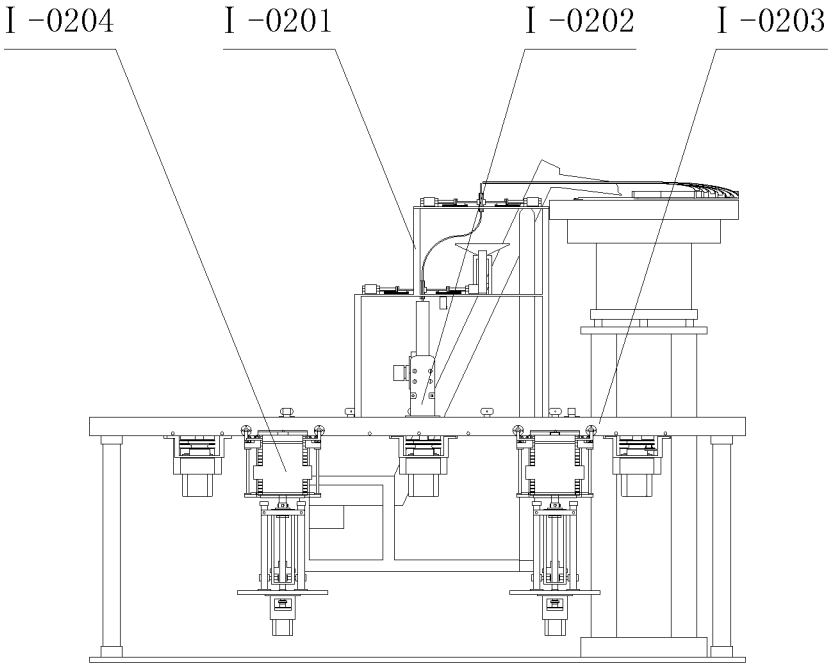
FIG. 13 is a front view of the blade loader apparatus according to Embodiment 1.
Figure 17:
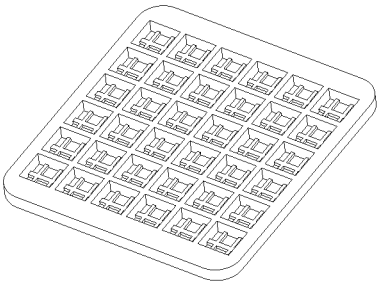
FIG. 17 is an axonometric view of a blade loading cutter head according to Embodiment 1.

As shown in FIG. 12, after the carbide blade gravity discharging loader I-02 receives the blade of which the double end surfaces are ground in the previous unit, the blade passes through a blade spiral vibratory feeding device I-0201, a blade forming storage device I-0202 and a blade loading device I-0203 as shown in FIG. 13, realizing batched filling of the blades into blade head. The filled cutter head is shown in FIG. 17, a blade placement groove in the cutter head is a rectangular groove, and a through hole is formed in a lower end supporting surface.

The loading realization principle is that through the blade spiral vibratory feeding device I-0201, the blades are fed along a spiral track, and under the action of a blade pose positioning block and a rejector, the blades are arranged according to a regular pose and conveyed along the track. In the device, a multi-track spiral vibratory feeding plate is used. A blade guiding rod is mounted at the tail end of a discharging opening of the track, vibration parameters of the vibratory plate are controlled, and thus, when the blades are discharged from the conveying track, the guiding rod penetrates through inscribed circular holes. In a working process, since parameters of the vibratory plate may randomly change irregularly, a small number of blades that have not penetrated through the guiding rod fall into a lower blade collecting box, and are conveyed to the slope conveying belt through a blade returning groove and fed again.

The blade falls into a storing channel of the blade forming storage device I-0203 along the guiding rod. The blade storing hole of the blade forming storage device is circular, and the size of the blade storing hole is greater than the circumscribed circle diameter of the loaded blade. In the linear moving process of the blade conveying plate of the blade loading device I-0203, as the blade storing channel of the storage device is superposed to a blade transition hole of the blade conveying plate, the blade loses supporting, and are automatically loaded into each group of blade transition holes in the blade conveying plate under the action of gravity. The blade transition hole and the blade storing hole of the blade forming storage device have the same size and shape, and both are circular.

The array arrangement shape of the blade transition holes is the same as the arrangement shape of blade placement grooves in the cutter head to be filled. When the blade conveying plate moves to the blade transition hole and positioned over the cutter head, a pulling plate between the cutter head and the blade conveying plate is rapidly pulled out under the driving of the driver, then the blade loses the planer supporting of the pulling plate and fall into rectangular blade groove in the cutter head. The size of the shortest side of the rectangular blade groove is slightly greater than the diameter of the circle of the blade transition hole.

The pulling plate is quite thin. A roller guiding device is mounted on a side of the pulling plate, which helps to pull out the plate rapidly. Under the restraint action of the side wall of the circular blade transition hole, the blade will fall vertically while pulling, and is then discharged into the cutter head.

Figure 14:
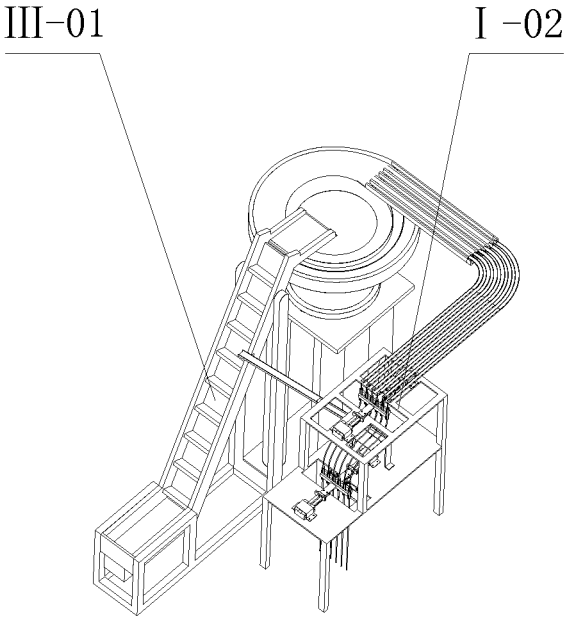
FIG. 14 is an axonometric view of a blade feeding device according to Embodiment 1.
Figure 15:
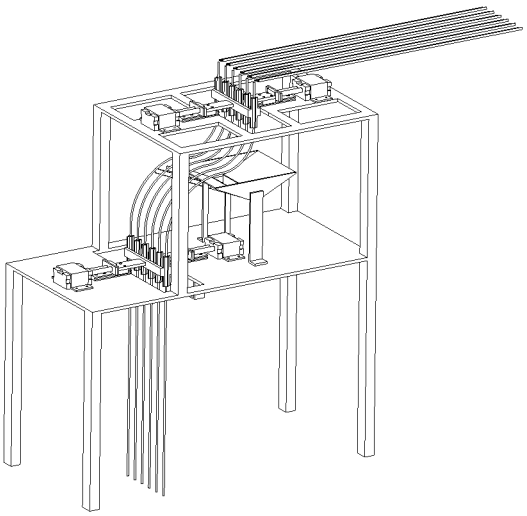
FIG. 15 is an axonometric view of a blade gravity discharging guiding device according to Embodiment 1.
Figure 16:
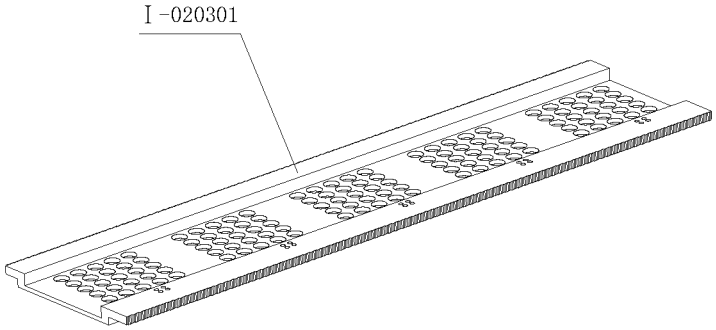
FIG. 16 is an axonometric view of a conveying plate for blade loading according to Embodiment 1.

The blade slope conveying belt III-01 is as shown in FIG. 14. Blade clapboards are provided on the blade slope conveying belt at equal distances, and under the action of the slope conveying belt driver, the blade in the blade feeding collecting box is added into the vibratory plate of the carbide blade gravity discharging loader I-02 in batches through a blade conveying discharging opening.

Figure 18:
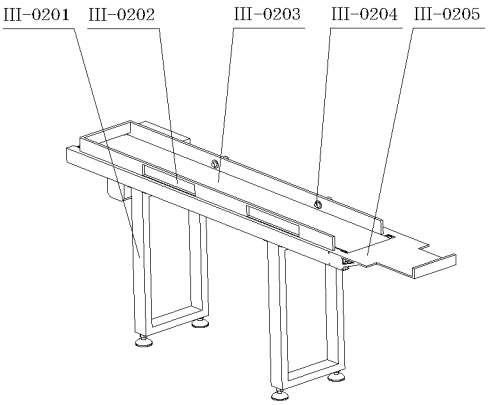
FIG. 18 is an axonometric view of a conveying belt for a discharging plate for the cutter head filled with the blade according to Embodiment 1.
Figure 19A:
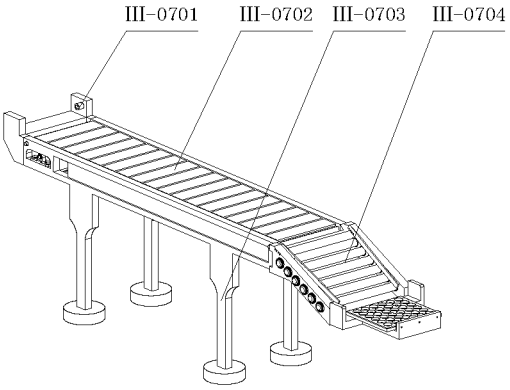
FIG. 19(*a*) is a structure diagram of a conveying belt for cutter head unit conversion according to Embodiment 1.
Figure 19B:
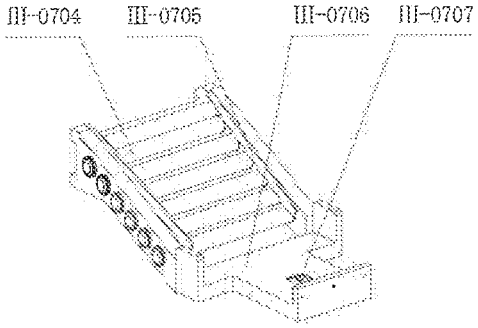
Figure 19C:
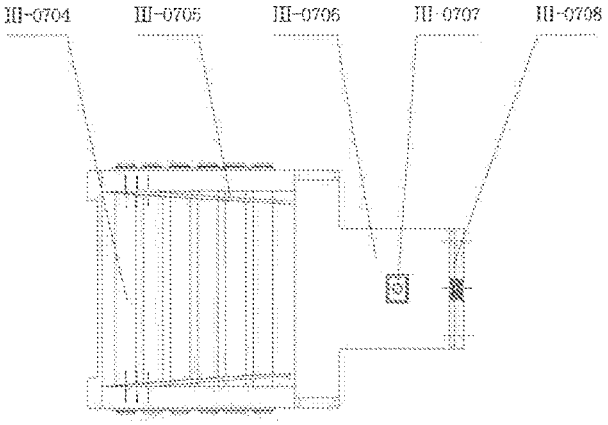

The cutter head filled with the blade is conveyed into the discharged cutter head conveying belt III-02 through a discharged cutter head conveying device, as shown in FIG. 18, a cutter head feeding hole is formed in a side plate at one end of a cutter head conveying clapboard III-0202, and the left side and the right side of the gravity discharging loader are each provided with a blade loading unit. Therefore, two cutter head feeding holes are formed in the side plate, and a discharged cutter head detection sensor III-0204 is mounted at the position, corresponding to the cutter head feeding holes, of an opposite side plate and is an infrared sensor.

Figure 20:
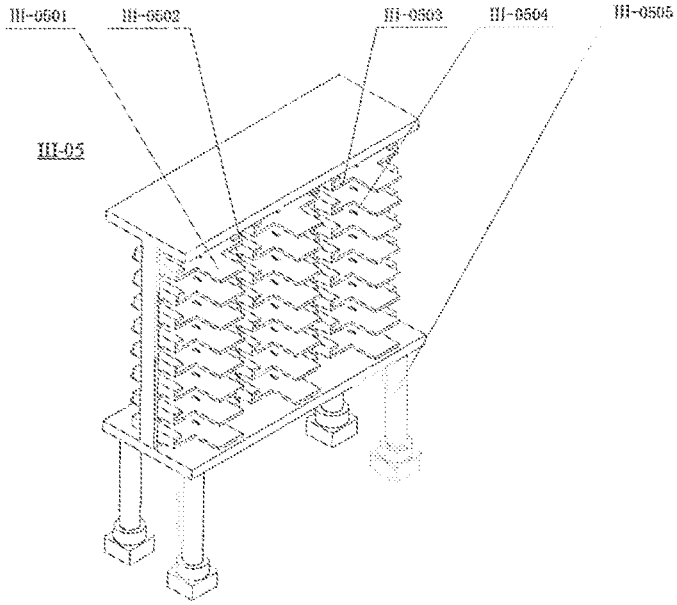
FIG. 20 is an axonometric view of a cutter head transfer station storage device according to Embodiment 1.

When the discharged cutter head is conveyed to the cutter head conveying belt III-0203 through a conveying device at the upper end via the cutter head feeding hole, the discharged cutter head detection sensor III-0204 detects that there is the discharged cutter head on the conveying belt at the moment, and feeds back information to a conveying belt control system to start the conveying belt to move, so as to convey the cutter head to a cutter head temporary storage device III-0205, waiting for a blade inventory filling manipulator III-03 to fill the cutter head into a cutter head transfer station storage device III-05. The cutter head transfer station storage device is as shown in FIG. 20.

The cutter head transfer station storage device III-05 adopts a stereoscopic warehouse type storing mode. Specifically, cutter head brackets III-0501 are arranged in the vertical direction and mounted on supports III-0505, an induction chip III-0504 is mounted on a bottom plate of each cutter head bracket III-0501 to monitor whether there is a cutter head on the cutter head bracket III-0501. A cutter head fixing groove III-0502 is provided in the edge of the side surface of the cutter head bracket III-0501, a manipulator grabs the cutter head and inserts the cutter head into the fixing groove. A slot III-0503 for accommodating a tail end of the manipulator is formed in a side surface of the bottom plate of the cutter head bracket III-0501. Moreover, the cutter head can be pulled and stored forwards and backwards, so that storing of the cutter head conveying device in the link at the upper end and pulling of the cutter head in the link at the lower end are facilitated. The cutter head transfer station storage device is provided with a counting unit which is used for numbering all the cutter head brackets. Data of cutter head bracket storing conditions are acquired through the induction chip III-0504, and the information is shared to the blade inventory filling manipulator III-03 at the upper end and a cutter head loading and uninstalling moving machine III-04 at the lower end in real time. Then, the fed cutter head is stored on an empty cutter head bracket, and the cutter head is pulled from the specified cutter head bracket for supplementation of the fed cutter head.

Figure 21:
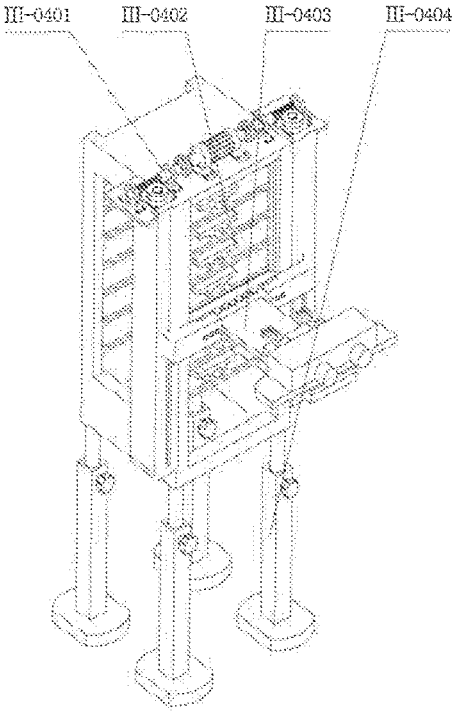
FIG. 21 is an axonometric view of a cutter head loading and uninstalling conveyor according to Embodiment 1.
Figure 22:
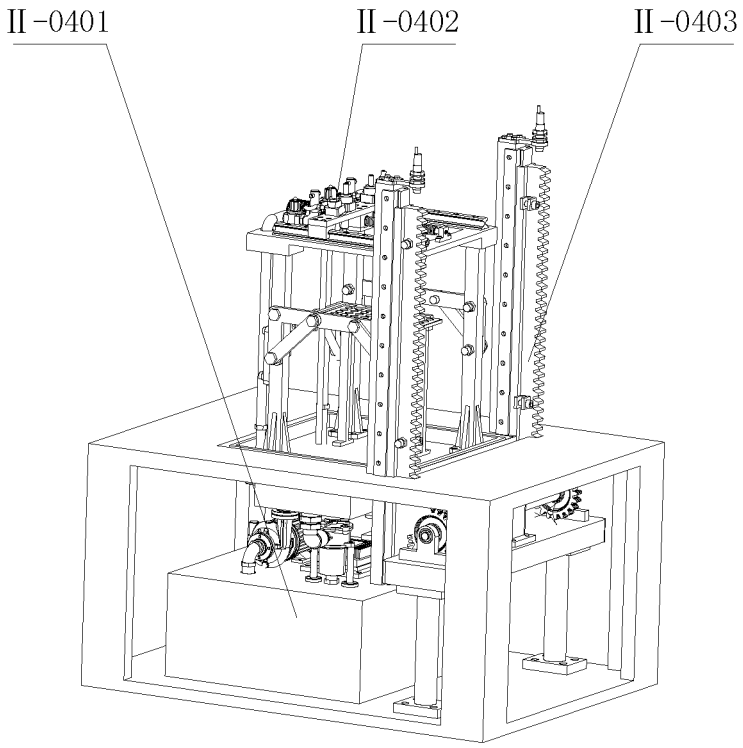
FIG. 22 is an axonometric view of a hydraulic pressure blade cleaning device according to Embodiment 1.
Figure 23:
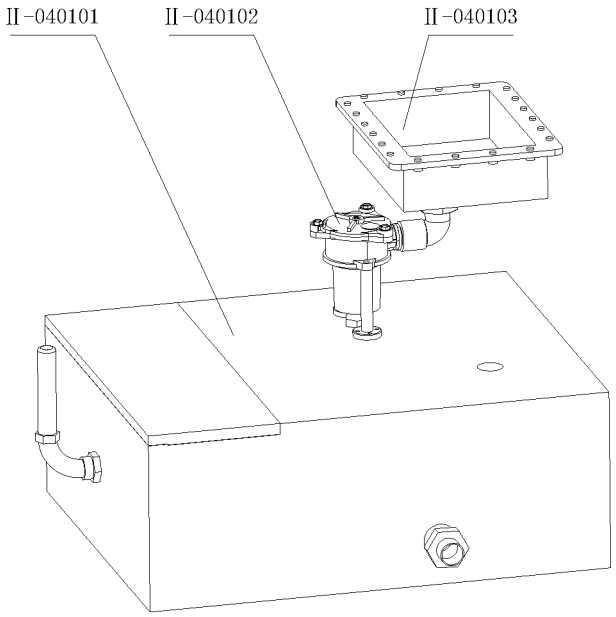
FIG. 23 is an axonometric view of a blade cleaning device of a water supply unit apparatus according to Embodiment 1.

The cutter head loading and uninstalling moving machine III-04 as is shown in FIG. 21, and is provided with a cutter head vertical placement frames III-0402 which are vertically fixed and arranged and have capability of temporarily storing a certain number of cutter head.

Grabbing and storing of the cutter head is completed by a cutter head telescopic grabbing manipulator III-0403. Here, the manipulator is provided with a telescopic device which has a telescopic grabbing function in the linear direction, and a rotating device is connected to the bottom of the manipulator, realizing the rotation in the circumferential direction, Moreover, in cooperation with a transporter lifting driver III-0401, the manipulator has a multi-degree-of-freedom grabbing capability. With a height-adjustable support III-0404, height can be adjusted. Meanwhile, an intelligent driving moving component AGV module is mounted at the bottom of the support, and can drive the cutter head telescopic grabbing manipulator III-0403 to move back and forth between the cutter head transfer station storage devices III-05 at the starting end and the tail ends. Meanwhile, the cutter head is fed on and discharged from blade grinding machine tools II-02 arranged on two sides. The blade periphery grinding machine II-02 is an intelligent machine tool, the periphery of the blade of which the end surface is ground is ground through the periphery grinding machine, including process grinding such as side grinding, cutting edge grinding, and blade chip breaker groove processing. A grinding wheel of the intelligent periphery grinding machine can carry out multi-degree-of-freedom rotation, a blade periphery grinding function is improved, the blade of which the end surface is ground can be multi-functionally on the same grinding machine, and thus, a blade grinding and forming process is completed with high efficiency.

After the grinding of the blade through the blade periphery grinding machine II-02 is completed, the geometric dimension of the outline of the blade meets the requirements, and the ground blade is still placed in the cutter head. The cutter head loading and uninstalling moving machine III-04 finally conveys the cutter head filled with the ground blade to the cutter head transfer station storage device III-05 at the tail end. In addition, a high-pressure water jet blade cleaning device II-04, an ultrasonic blade cleaning machine II-05 and a blade air dryer II-03 are mounted on the other side and are arranged annularly, and a cutter head loading and uninstalling manipulator III-06 is arranged in the middle.

The ground blade is cleaned and dried, and then conveyed to a subsequent visual monitoring device for detection of geometric dimension of the appearance of the processed blade. In the production line, the cutter head is taken as a working carrier for cleaning and air drying of the blade. The cutter head loading and uninstalling manipulator III-06 grabs the cutter heads from the cutter head transfer station storage device III-05 at the tail end and successively conveys the cutter heads to the high-pressure water jet blade cleaning device II-04 for high-pressure water preliminary flushing of the blades which are then conveyed into the ultrasonic blade cleaning machine II-05 for ultrasonic deep cleaning, and further conveyed into the blade air dryer II-03 for air drying. The cutter head used is as shown in FIG. 17, a through hole is formed in the bottom of the cutter head, during high-pressure water flushing, water flows out via the through hole, meanwhile, in a process of air-drying the blade with heated compressed air, a mixture of air and water is discharged via the through hole, and thus, cleaning fluid on the surface of the blade can be removed to the maximum extent.

Figure 24:
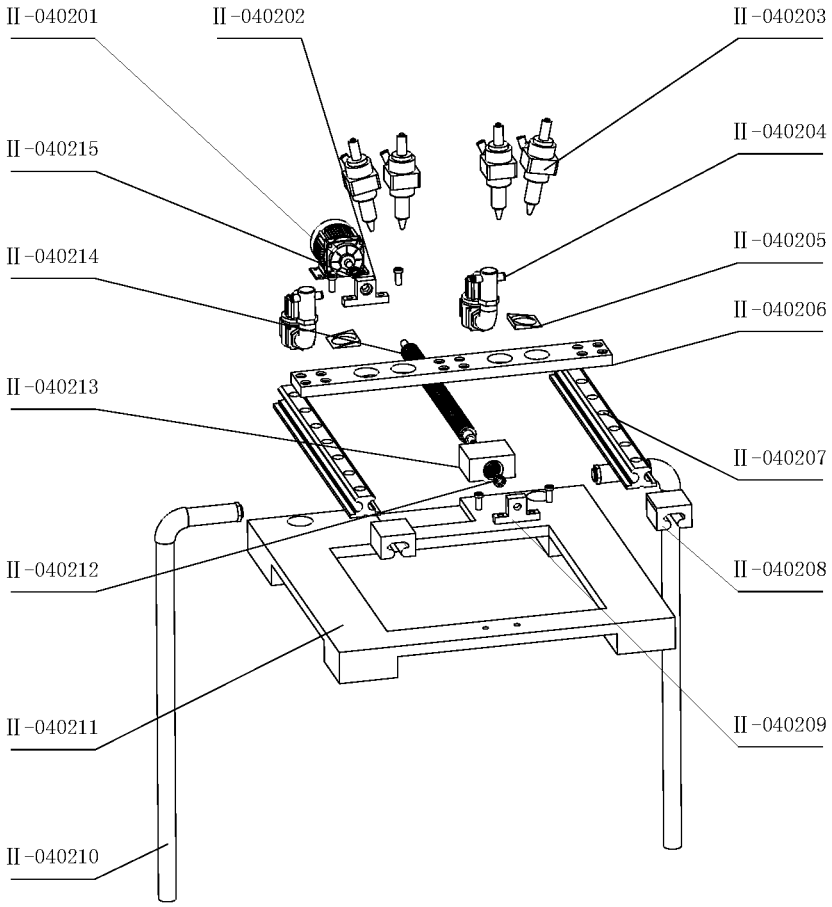
FIG. 24 is an exploded view of assembling components of a water jet blade cleaning device assembling component according to Embodiment 1.
Figure 25:
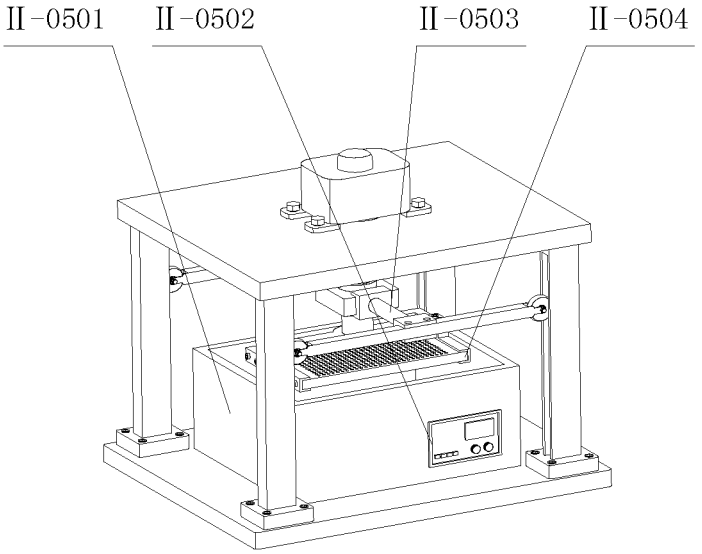
FIG. 25 is an axonometric view of an ultrasonic blade cleaning device according to Embodiment 1.
Figure 26:
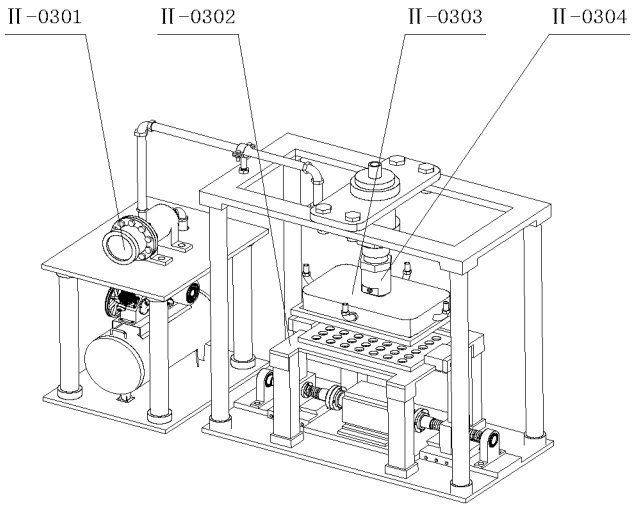
FIG. 26 is an axonometric view of a blade compressed air drying device according to Embodiment 1.
Figure 27:
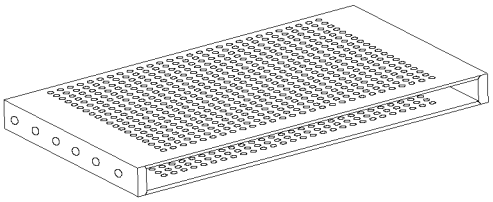
FIG. 27 is an axonometric view of a cutter head fixing box of the ultrasonic blade cleaning device according to Embodiment 1.
Figure 28A:
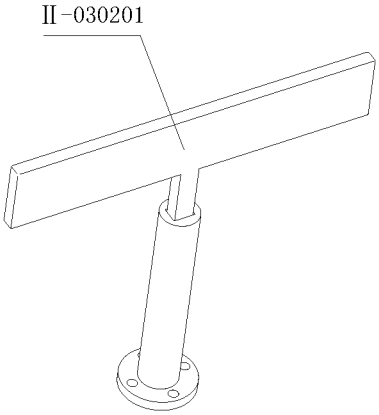
FIG. 28(*a*) is an axonometric view of a feeding positioning plate of the blade drying device according to Embodiment 1.
Figure 28B:
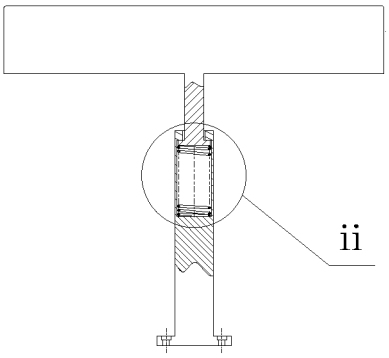
Figure 28C:
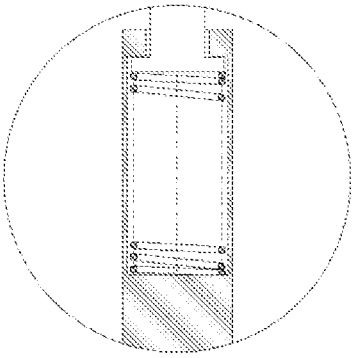
Figure 28D:
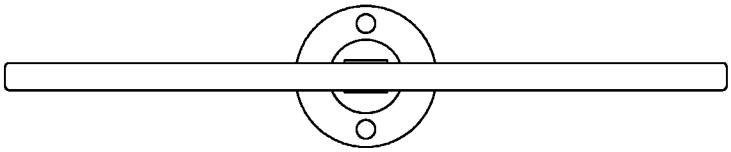

Blade cleaning is carried out through high-pressure water jet flushing and ultrasonic mixed cleaning, which improves the cleaning quality of the blade. Meanwhile, high-pressure water jet cleaning apparatus adopts a water circulation working mode, in which a cleaning water supply tank II-040101 is provided with a recirculation water connector and communicates with a recirculation water collecting tank II-040103 through a recirculation water filter II-040102. Recirculation water cleaning impurities are filtered and attached to the surface of a filter element, after recirculation water which has been filtered primarily enters the water supply tank, the water is filtered secondarily through a recirculation water filter screen of the water supply tank, such that the recirculation water filtering quality is improved. The filter element and cleaning water for the apparatus are required to be changed regularly. High-pressure water flushes the blade in the cutter head through a nozzle, a water jet nozzle II-040203 is mounted on a nozzle moving fixing plate II-040206, and the fixing plate linearly moves through cooperation of a ball screw structure and a guide track sliding block component, such that the cutter head is flushed. The exploded view of a blade high-pressure water jet device component is as shown in FIG. 24, the high-pressure water is delivered into the water jet nozzle II-040203 through a water supply pipe II-040210 by an electromagnetic water flow control switch II-040204, and the electromagnetic switch is connected to the nozzle through a flexible high-pressure-resistant hose. After high-pressure water flushing, the cutter head is carried by the manipulator and conveyed into an ultrasonic cleaning tank. Under the action of the manipulator, the cutter head is inserted into a cutter head fixing box as shown in FIG. 27. The lifting cleaning driver II-0503 descends to soak the cutter head into the cleaning tank for cleaning. After cleaning is completed, the driver ascends to enable the cutter head to leave the cleaning tank. The manipulator takes out the cutter head and conveys the cutter head into the blade air dryer II-03 to air-dry the blade, and the blade air dryer II-03 uses heated compressed air to blow the blade, such as to remove the water.

The high-pressure water cleaning device, the ultrasonic cleaning device, and the blade air dryer operate sequentially. A same single working time t is set for the three devices. After single cleaning and air drying is completed, the manipulator takes out the cutter head in the air dryer, conveys the cutter head to an intelligent cutter head conveying belt III-07 and then conveys the cutter head to a blade detection unit. The blade in ultrasonic cleaning is taken out and conveyed to the air dryer. Then the cutter head in the high-pressure water cleaning device is taken out and conveyed into the ultrasonic cleaning device. Finally, cutter head to be cleaned is taken out from the cutter head transfer station storage device III-05 at the tail end and are conveyed into the high-pressure water cleaning device. The foregoing process is one-time working circulation cutter head conveying sequence. The cleaned cutter head is conveyed to the blade detection unit through the intelligent cutter head conveying belt III-07 and monitored. When the detection unit cannot meet the production rhythm of the link at the upper end due to apparatus fault or other reasons, the cutter head loading and uninstalling manipulator III-06 conveys the air-dried cutter head to the cutter head transfer station storage device III-05 at the tail end for temporary storage. The monitoring of the blade will be carried out after the detection apparatus recovers.

Figure 35:
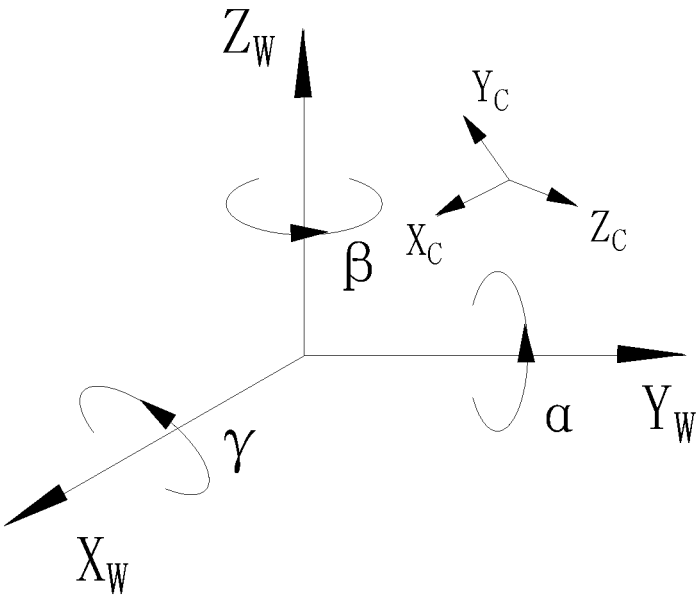
FIG. 35 is a schematic diagram of camera calibration coordinate conversion according to Embodiment 1.

The blade detection unit IV adopts a machine vision detection system. The basic task of machine vision detection is to calculate and analyze information such as the shape and the space position of a three-dimensional target object by utilizing a two-dimensional image of the target object captured by a camera. Firstly, a relation model between a surface point of the three-dimensional object and a pixel point of the two-dimensional image needs to be established for the whole detection system. Meanwhile, this relation model is determined by a geometric model imaged by the camera, and the model is the parameter of the camera. Determining the model parameter by experimental calculation is the calibration process of the camera, and the model selection of the camera is performed by a calibration model selection visual system. Calibration of the camera involves conversion between coordinate systems, i.e., the conversion between the camera coordinate system and the world coordinate system and between the physical coordinate system and the pixel coordinate system, and the conversion calculation is carried out through a coordinate relation conversion matrix:

(1) Conversion between the camera coordinate system and the world coordinate system is completed through a rotation matrix R and a translation matrix t, and a relation conversion equation is as follows:

$$\begin{bmatrix} X_c \\ Y_c \\ Z_c \\ 1 \end{bmatrix} = \begin{bmatrix} R & t \\ 0^T & 1 \end{bmatrix} \begin{bmatrix} X_w \\ Y_w \\ Z_w \\ 1 \end{bmatrix}$$

in the equation, R is an orthogonal rotation matrix of 3×3, t is a translation vector, and $0^T(0, 0, 0)$. Points in the world coordinate system can be converted into the camera coordinate system through rotation conversion and translation conversion. Rotation may be understood as two-dimensional rotation around X, Y, Z axes in three-dimensional space, and as shown in FIG. 35, assuming that the rotation angles are α, β, γ in turn, the rotation matrix R can be expressed as follows:

$$R = \begin{bmatrix} 1 & 0 & 0 \\ 0 & \cos\alpha & \sin\alpha \\ 0 & -\sin\alpha & \cos\alpha \end{bmatrix} \begin{bmatrix} \cos\beta & 0 & -\sin\beta \\ 0 & 1 & 0 \\ \sin\beta & 0 & \cos\beta \end{bmatrix} \begin{bmatrix} \cos\gamma & \sin\gamma & 0 \\ -\sin\gamma & \cos\gamma & 0 \\ 0 & 0 & 1 \end{bmatrix} = \begin{bmatrix} r_{11} & r_{12} & r_{13} \\ r_{21} & r_{22} & r_{23} \\ r_{31} & r_{32} & r_{33} \end{bmatrix}$$

the translation vector $t=[t_1\ t_2\ t_3]^T$ is used to indicate that the origin of the world coordinate system moves to the origin of the camera coordinate system.

(2) The conversion relation between the camera coordinate system ($X_x$, $Y_c$, $Z_c$) and image physical coordinate system (x, y) can be expressed as follows:

$$Z_c \begin{bmatrix} x \\ y \\ 1 \end{bmatrix} = \begin{bmatrix} f & 0 & 0 & 0 \\ 0 & f & 0 & 0 \\ 0 & 0 & 1 & 0 \end{bmatrix} \begin{bmatrix} X_c \\ Y_c \\ Z_c \\ 1 \end{bmatrix}.$$

(3) After the camera acquires a digital graph, the digital graph is stored in a computer memory in a matrix form, with single pixel as unit, and considering that only a few pixels are inclined, the relation expression of converting the physical coordinate system (x, y) into the pixel coordinate system (u, v) is expressed as follows:

$$\begin{bmatrix} u \\ v \\ 1 \end{bmatrix} = \begin{bmatrix} 1/d_x & 0 & u_o \\ 0 & 1/d_y & v_o \\ 0 & 0 & 1 \end{bmatrix} \begin{bmatrix} x \\ y \\ 1 \end{bmatrix}$$

where $(u_o, v_o)$ represents the position of the principal point $O_1$ in the pixel coordinate system, $d_x$ represents the actual size of a pixel point in the X direction, and $d_y$ represents the actual size of a pixel point in the y direction. Conversion of the camera coordinate system is realized through the conversion relation, and further the camera is calibrated to determine the parameters of the camera.

Figure 29:
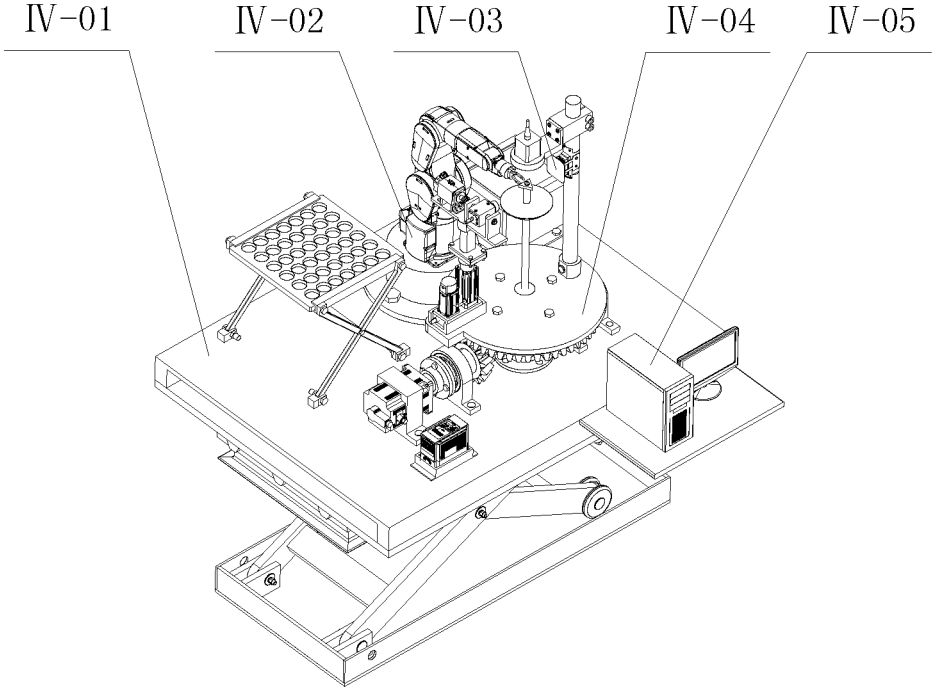
FIG. 29 is an axonometric view of a blade visual detection apparatus according to Embodiment 1.

The blade detection unit includes a visual monitoring work fixing table IV-01, a blade loading and uninstalling robot IV-02, a blade image acquisition device IV-03, a multi-angle image acquisition driver IV-04, and an industrial computer IV-05, as shown in FIG. 29. A lifting device is mounted at the lower end of the visual monitoring work fixing table IV-01, the height of the monitoring device is adjustable to adapt to the working height of the conveying belt, and the manipulator can conveniently grab the cutter head from the conveying belt. In the detection process, the blade is taken out from the cutter head through the cutter head loading and uninstalling robot IV-02, and placed on a blade detection table. The multi-angle image acquisition driver IV-04 drives two CCD cameras in the blade image acquisition device IV-03 in the vertical direction and the horizontal direction to acquire images of the blade. The acquired multi-angle blade images are identified and analyzed through the industrial computer IV-05 to judge whether the geometric dimension of the appearance of the ground blade meets the processing requirements or not.

A rotating plate IV-0409 as a main working component of the multi-angle image acquisition driver IV-04 rotates in the working process, drives the CCD camera 2 IV-0313 fixed to the rotating plate to do circular motion along the blade so as to acquire, analyze, and judge images, as well as acquire, analyze and judge images for the cutting edge of the blade, and detect whether the cutting edge and the corner of the blade exceed an error range or not. Meanwhile, a CCD camera 1 IV-0306 is mounted at the vertical top end of the blade through a fixing device to carry out image acquisition and analysis for the size of end surface of the blade, and judge whether the geometric dimension of the appearance of the end surface of the blade exceeds an error range or not. Fixed back lights are mounted at positions facing the two CCD cameras. The blade is located between the camera and the back light. The back light is made of a material with certain transparency, and an illuminating light source is mounted on the back surface of the back light. Under the action of the illumination light source and the back light, the contrast between the acquired blade and the background is improved, the image processing speed is increased, and the working efficiency is improved.

Figure 30:
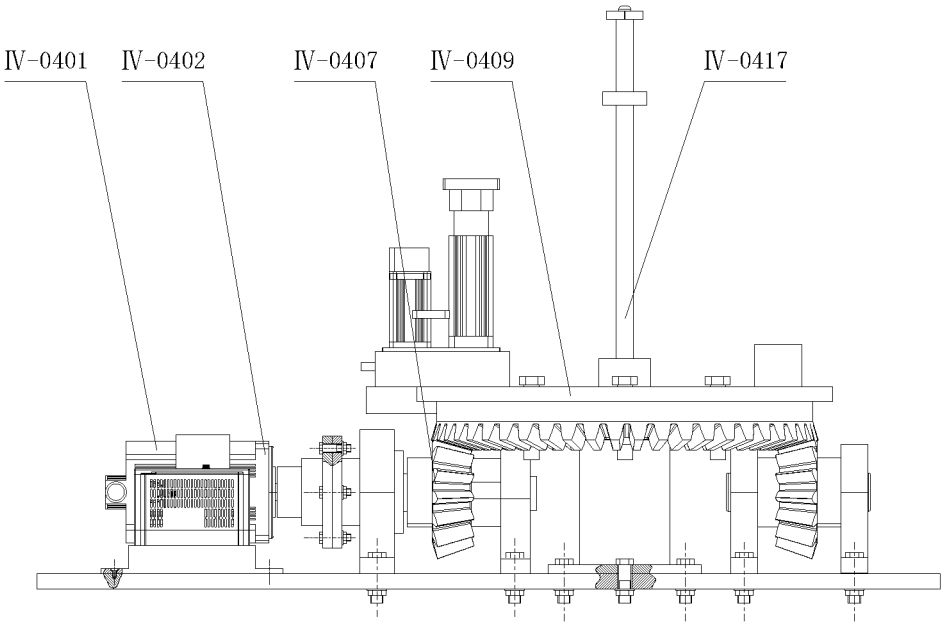
FIG. 30 is a front view of the blade visual detection apparatus according to Embodiment 1.
Figure 31A:
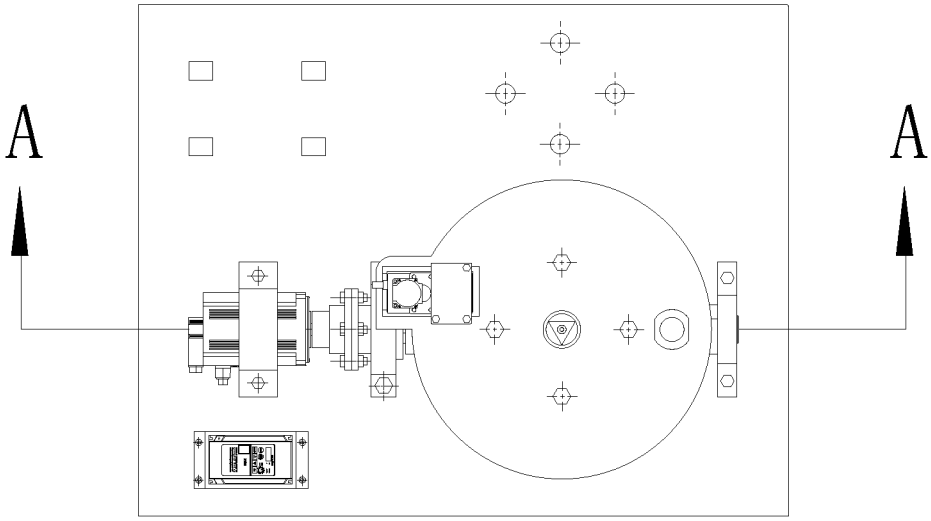
FIG. 31(*a*) is a top view of the blade visual detection apparatus according to Embodiment 1.
Figure 31B:
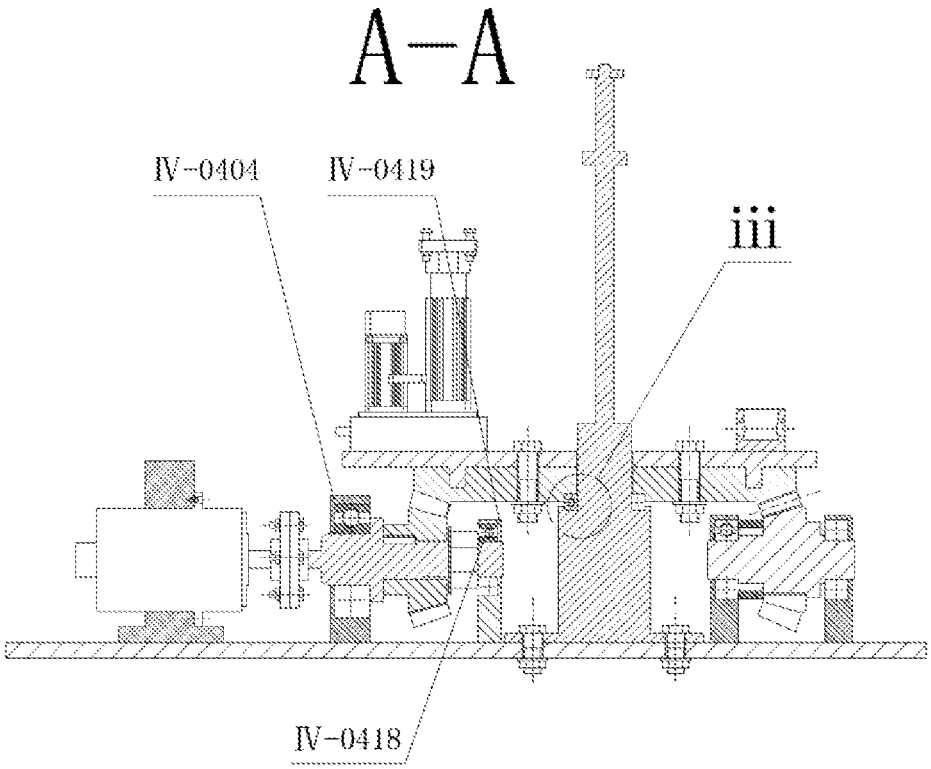
Figure 31C:
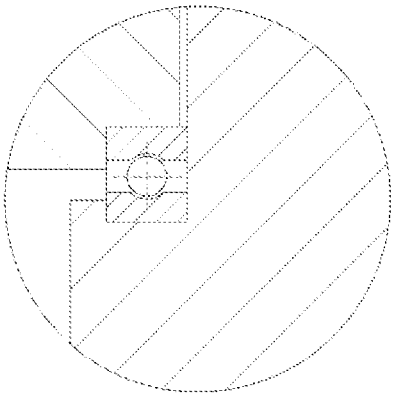
Figure 32A:
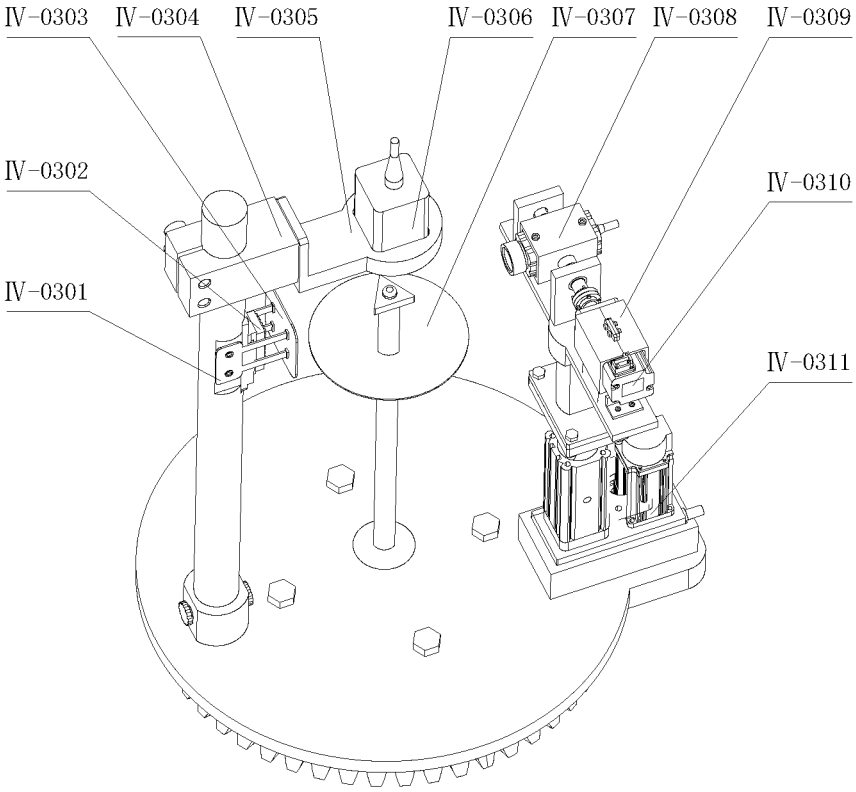
FIG. 32(*a*) is an axonometric view of an image acquisition device of the blade visual detection apparatus according to Embodiment 1.
Figure 32B:
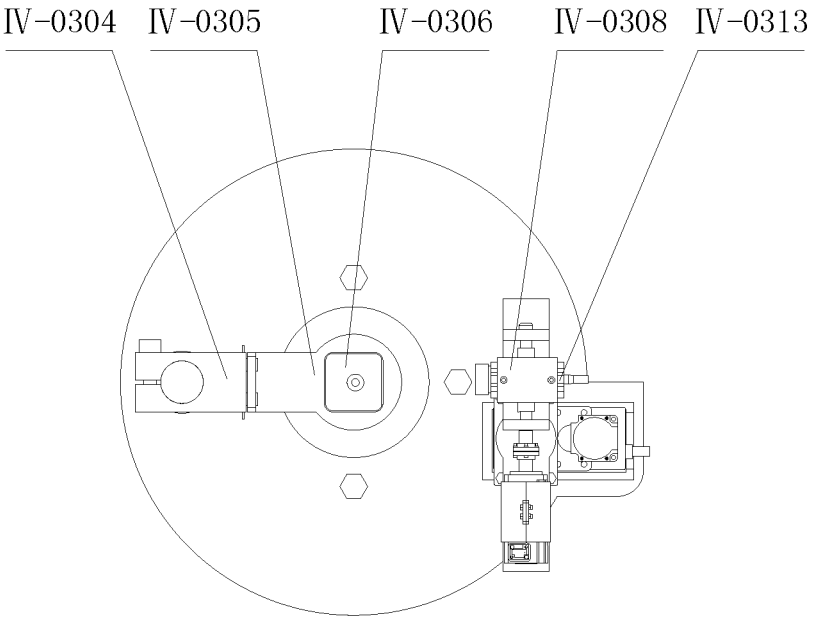
Figure 33:
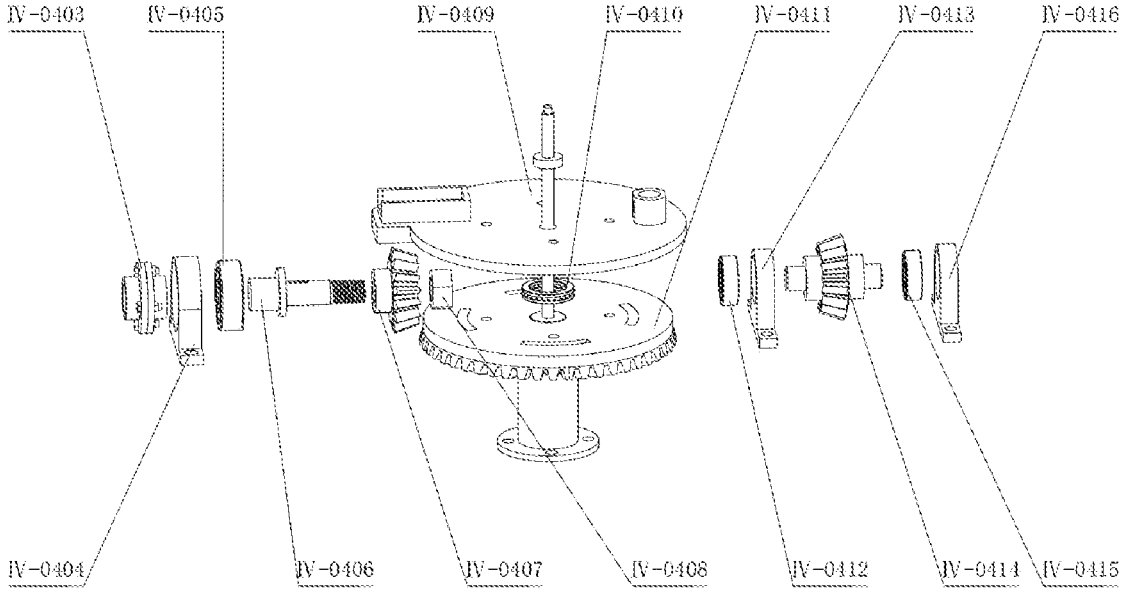
FIG. 33 is an exploded view of assembling components of an image acquisition moving unit according to Embodiment 1.
Figure 34:
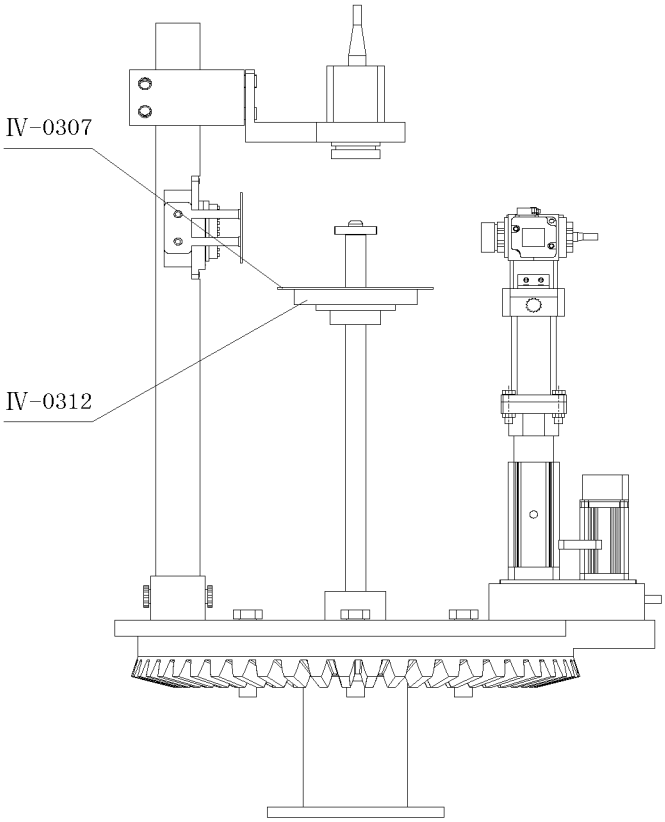
FIG. 34 is a front view of the image acquisition device of the blade visual detection apparatus according to Embodiment 1.

As shown in FIG. 32, the CCD camera 2 IV-0313 and the vertical back light IV-0303 are both fixedly mounted on the rotating plate IV-0409, and always located on the same horizontal line in a rotating process, with the blade located therebetween. A circular hole is formed in the middle of the rotating plate IV-0409, a blade placement rod IV-0417 penetrates through the circular hole, and the bottom end of the blade placement rod is fixed to the visual monitoring work fixing table IV-01 through bolts, as shown in FIG. 30. The blade is always kept stationary, so that as the rotating plate IV-0409 drives the camera to rotate to generate movement relative to the stationary blade, the geometric dimension of the lateral cutting edge of the blade and images of the corner of the blade in the whole circumferential direction can be acquired.

The rotating plate IV-0409 is fixedly connected to a rotation driving plate IV-0411 through bolts and circumferential positioning blocks. The rotation fixing plate is of a plate gear structure, and the rotating plate is driven to do circumferential rotation through a driving bevel gear IV-0407 engaged with the rotation fixing plate. One end of the driving bevel gear IV-0407 is connected to a disc rotation driving motor IV-0401 through a coupling IV-0403, and a supporting bevel gear IV-0414 at the other end of the driving bevel gear is engaged with the rotation driving plate IV-0411. During the rotation of the rotation driving plate, the supporting bevel gear is driven. The two ends of the bevel gear are fixedly supported through a bearing and a bearing block, as shown in an exploded view of an assembling component in FIG. 33, the bearing block is fixed to the visual monitoring work fixing table IV-01 through bolts, and the disc rotation driving motor IV-0401 is fixed through a motor fixing seat IV-0402.

The production line has the following specific working processes of blade grinding processing and conveying: the initial link of the production line is an end surface grinding process of the blade, in which the punched and sintered carbide blade is conveyed to a blade end surface grinding machine tool II-01 for grounding of the double end surfaces of the blade, a single-end-surface grinding machine is used to grind the end surface of the blade, and after grinding of the single end surface of the blade is completed, the carbide blade end surface grinding cutter die box overturning device I-01 overturns the cutter die box and the blade for 180 degrees, and then is uninstalled to a workbench for refeeding, so that a process of disassembling the blade from the cutter die box and then filling the blade into the cutter die box again is omitted.

After the grinding of the double end surfaces of the blade is completed, the blade is conveyed into a feeding hopper of the blade slope conveying belt III-01 through a discharging hole in a side of a cutter die box feeding workbench by the conveying belt. Next, the blade is conveyed into the carbide blade gravity discharging loader I-02, and is filled into the cutter head as the blade transporting, processing and feeding carrier of the production line with a gravity loading method of the blade loader, as shown in FIG. 17, a blade groove for accommodating the blade of the cutter head is a rectangular blade groove, a square through hole is formed in the supporting surface of the lower surface of the blade, and thus, the ground blade in the cutter head can be conveniently cleaned and water can be removed.

The cutter head filled with the blade is conveyed to the discharged cutter head conveying belt III-02 through a discharged conveying device of the loader. After a sensor of the cutter head conveying belt III-02 senses the cutter head, the conveying belt is started to convey the cutter head to a specified position at the tail end. The blade inventory filling manipulator III-03 grabs the cutter head and conveys the cutter head to the cutter head transfer station storage device III-05 at the starting end for storing. The cutter head loading and uninstalling moving machine III-04 takes the cutter head from the cutter head transfer station storage device III-05 at the starting end and carries out loading and uninstalling of the cutter head in a space between the blade periphery grinding machine II-02. The cutter head loading and uninstalling moving machine III-04 is equipped with an AGV functional module which is in communication connection with various machine tools in the blade periphery grinding machine II-02. After the processing of the machine tool is completed, the cutter head loading and uninstalling moving machine III-04 moves to a feeding position of the machine tool through the AGV functional module to take the processed cutter head, and feed the cutter head with the blades which are not processed in the working procedure.

The cutter head loading and uninstalling moving machine III-04 is provided with a cutter head temporary storing tank which has a cutter head storing function, and can mark the blades which have been ground and blades which are about to be ground in the cutter head in the storing tank. For example, after the periphery of the blade is ground, the cutter head loading and uninstalling moving machine III-04 stores the cutter head into the storing tank, after the grinding of the blade on a chip breaker groove grinding machine is completed, the cutter head is discharged, and then the cutter head with the blade of which periphery grinding is completed in the temporary storing tank is fed to the chip breaker groove grinding machine for grinding.

After all periphery grinding of the blade is completed, the cutter head loading and uninstalling moving machine III-04 conveys the cutter head into the cutter head transfer station storage device III-05 at the tail end. The cutter head loading and uninstalling manipulator III-06 successively conveys the cutter head with the ground blade to the high-pressure water jet blade cleaning device II-04, the ultrasonic blade cleaning machine II-05 and the blade air dryer f II-03 for cleaning and air drying of the blade along with the cutter head. After the process is completed, the cutter head is conveyed to a blade visual detection end through the intelligent cutter head conveying belt III-07 for detection of appearance and geometric size of the blade. Unqualified blades are removed, and the remaining blades, together with the cutter head, are conveyed to a subsequent blade processing production line for processing.

The foregoing descriptions are merely preferable embodiments of the present disclosure, but are not intended to limit the present disclosure. The present disclosure may include various modifications and changes for a person skilled in the art. Any modification, equivalent replacement, or improvement made within the spirit and principle of the present disclosure shall fall within the protection scope of the present disclosure.

What is claimed is:

1. A carbide blade grinding forming processing production line, comprising:

a blade supply unit, comprising a cutter die box overturning device cooperated with a blade processing unit and a loader cooperated with a blade conveying unit, an overturning unit of the cutter die box overturning device being provided with an overturning cavity for accommodating a cutter die box, wherein the blade processing unit is configured to grind and clean the blade and comprises an end surface grinding machine, a periphery grinding machine and a cleaning device, the end surface grinding machine being provided with an end surface grinding station for accommodating the cutter die box, the periphery grinding machine being provided with a periphery grinding station, and the cleaning device being cooperated with the end surface grinding machine and the periphery grinding machine, the blade conveying unit comprises a transportation mechanism, a filling manipulator, and a cutter head transfer station storage device, both the transportation mechanism and the filling manipulator being cooperated with the blade supply unit, the blade processing unit and a blade detection unit, and the cutter head transfer station storage device being cooperated with the filling manipulator, the blade detection unit comprises an image acquisition device and is configured to acquire image information of the blade on a fixing table and transmit the image information to a controller, and the overturning device comprises the overturning unit, a fixing plate rotatably connected to the overturning unit and an uninstall rod cooperated with the overturning cavity, an access channel which penetrates through the fixing plate and corresponds to the overturning cavity is formed in the fixing plate, the uninstall rod moves relatively to the overturning cavity, and is used for pushing the cutter die box out of the overturning cavity along the access channel.

2. The carbide blade grinding forming processing production line according to claim 1, wherein the overturning cavity penetrates through the overturning unit, the overturning unit is provided with clapboard sliding grooves corresponding to openings in two ends of the overturning cavity, and an overturning clapboard is cooperated in each clapboard sliding groove for blocking or opening the overturning cavity.

3. The carbide blade grinding forming processing production line according to claim 1, wherein the loader comprises a vibratory feeding mechanism, a guiding mechanism, a loading mechanism and a discharging mechanism which are successively arranged, the guiding mechanism receives the blade discharged from the vibratory feeding mechanism and conveys the blade to the loading mechanism, and the loading mechanism conveys a cutter head filled with the blade to the discharging mechanism for discharging.

4. The carbide blade grinding forming processing production line according to claim 1, wherein the cleaning device comprises a water jet cleaning mechanism, an ultrasonic cleaning mechanism, and an air drying mechanism which are successively arranged for water jet cleaning, ultrasonic cleaning and air drying of the blade filled in a cutter head.

5. The carbide blade grinding forming processing production line according to claim 1, wherein the transportation mechanism comprises a blade slope transportation belt, a discharged cutter head conveying belt, a cutter head loading and uninstalling moving machine and an intelligent cutter head conveying belt; and the filling manipulator comprises a cutter head loading and uninstalling manipulator and an inventory filling manipulator.

6. The carbide blade grinding forming processing production line according to claim 5, wherein the cutter head transfer station storage device comprises cutter head brackets arranged in an array, an induction chip is cooperatively arranged on a bottom plate of each cutter head bracket, a fixing groove cooperated with the cutter head is formed in a side surface of each cutter head bracket, and a slot for accommodating a tail end of the filling manipulator is formed in a side surface of the bottom plate of each cutter head bracket.

7. The carbide blade grinding forming processing production line according to claim 6, wherein the cutter head brackets are mounted on a support, and the cutter head loading and uninstalling manipulator is mounted on the support, and cooperates with the cutter head brackets to take out or store the cutter head.

8. The carbide blade grinding forming processing production line according to claim 1, wherein the blade detection unit further comprises a loading and uninstalling robot and a collecting driver which are mounted on the fixing table, the collecting driver comprises a rotating rack, a placement rod and a fixed rack, the placement rod and the fixed rack are arranged on the rotating rack at an interval, a first end of the placement rod is fixed to the rotating rack, and a second end of the placement rod is configured for a placement of the blade.

9. The carbide blade grinding forming processing production line according to claim 8, wherein the image acquisition device comprises a first CCD camera mounted above the second end of the placement rod and a second CCD camera mounted beside the second end of the placement rod, a horizontal backlight is arranged on a side, which is away from the first CCD camera, of the second end of the placement rod, a vertical backlight is arranged on another side, which is away from the second CCD camera, of the second end of the placement rod, and the blade is driven by the placement rod to rotate relative to the image acquisition device.

* * * * *